US005904136A

United States Patent [19]

Nagatsuka et al.

[11] Patent Number: 5,904,136

[45] Date of Patent: May 18, 1999

[54] WIRE SAW AND SLICING METHOD THEREOF

[75] Inventors: Shinji Nagatsuka; Shinji Shibaoka; Jiro Tsuchishima, all of Mitaka, Japan

[73] Assignee: Tokyo Seimitsu Co., Ltd., Tokyo, Japan

[21] Appl. No.: 08/866,097

[22] Filed: May 30, 1997

[30] Foreign Application Priority Data

| | | | |
|---|---|---|---|
| Jun. 4, 1996 | [JP] | Japan | 8-141354 |
| Jun. 4, 1996 | [JP] | Japan | 8-141480 |
| Jun. 4, 1996 | [JP] | Japan | 8-141770 |
| Jun. 4, 1996 | [JP] | Japan | 8-142045 |

[51] Int. Cl.[6] ..... B28D 1/08

[52] U.S. Cl. ..... 125/16.02; 125/35

[58] Field of Search ..... 125/16.02, 21, 125/35; 451/364, 405, 403, 380, 387; 83/651.1

[56] References Cited

U.S. PATENT DOCUMENTS

| | | | |
|---|---|---|---|
| 2,947,214 | 8/1960 | Schwuttke et al. | 125/35 |
| 5,099,820 | 3/1992 | Stricot | 125/16.02 |
| 5,720,271 | 2/1998 | Hauser | 125/16.02 |
| 5,839,424 | 11/1998 | Hauser | 125/35 |

FOREIGN PATENT DOCUMENTS

| | | | |
|---|---|---|---|
| 2752925 | 5/1979 | Germany | 125/35 |
| 55-112755 | 8/1980 | Japan | 125/21 |

*Primary Examiner*—Robert A. Rose

*Attorney, Agent, or Firm*—Sixbey, Friedman, Leedom & Ferguson; David S. Safran

[57] ABSTRACT

The crystal orientation of a workpiece is determined and a tilt angle of the workpiece is adjusted based on the determined crystal orientation at the outside of a wire saw, and then the workpiece is attached to a workpiece feed table of the wire saw so that the slicing can be started.

13 Claims, 21 Drawing Sheets

WIRE SAW AND SLICING METHOD THEREOF

BACKGROUND OF THE INVENTION

1. Field of the Invention

The present invention relates to a wire saw and a workpiece slicing method thereof, and more particularly to a wire saw and a workpiece slicing method thereof for slicing brittle materials such as silicon, glass and ceramics.

2. Description of the Related Art

When the wire saw slices a single crystal material such as silicon into wafers, the single crystal material must be tilted by a predetermined angle with respect to a plane including a wire row of the wire saw so that the face of the sliced wafer can be a desired crystal face.

In the conventional wire saw, tilting equipment, which is integrated with a workpiece feed table, adjusts a tilt angle of the workpiece. The tilting equipment supports the workpiece so that the workpiece can swing horizontally and vertically with respect to the plane of the wire row. An operator manually adjusts the tilt angle of the workpiece based on the previously-obtained data relating to the crystal orientation of the workpiece.

Since the tilting operation in the wire saw has to be done in a limited space, the operation is extremely difficult. In addition, the operation takes time, and the slicing cannot be efficiently performed.

In the conventional method of adjusting the tilt angle of the workpiece, if an error takes place when the workpiece is attached to the tilting equipment, the error will not be noticed. Thus, inferior wafers will be manufactured.

Furthermore, the conventional wire saw slices only one workpiece per slicing. For this reason, if the workpiece is much shorter than the width of the wire row, much of the wire row can not contribute to the slicing, and the manufacturing efficiency is lowered.

SUMMARY OF THE INVENTION

The present invention has been developed in view of the above-described circumstances, and has as its object the provision of a wire saw and a workpiece slicing method thereof in which the workpiece can be sliced efficiently.

To achieve the above-mentioned object, a wire saw of the present invention in which a running wire is wound on a plurality of grooved rollers to form a wire row, a workpiece is attached to a workpiece feed table which moves forward and backward with respect to the wire row, and the workpiece feed table is fed toward the wire row so as to press the workpiece against the wire row, so that the workpiece is sliced into a number of wafers, the wire saw comprises: a tilting unit for holding the workpiece and tilting the workpiece horizontally and vertically by predetermined angles with respect to a plane including the wire row, the tilting unit being removably attached to the workpiece feed table; and the wire saw is characterized in that the tilting unit adjusts, at the outside of the wire saw, horizontal and vertical tilt angles of the workpiece, and then the workpiece is attached to the workpiece feed table via the tilting unit so as to slice the workpiece.

According to the invention of claim 1, the horizontal and vertical tilt angles of the workpiece are adjusted at the outside of the wire saw so that the workpiece can be sliced in a predetermined crystal orientation. Thereafter, the workpiece is attached to the work feed table, and the slicing of the workpiece is started.

According to the invention of claim 7, a plurality of workpieces are attached to a plurality of tilting units. Then, the horizontal and vertical tilt angles with respect to the plane of the wire row are adjusted for each workpiece by each tilting unit so that the workpiece can be sliced in a predetermined crystal orientation. Then, the workpiece feed table is fed toward the wire row, and the workpieces are sliced into wafers. Thus, in the present invention, a plurality of workpieces can be sliced at the same time.

According to the invention of claim 8, the horizontal and vertical tilt angles of the workpiece are adjusted at the outside of the wire saw so that the workpiece can be sliced in a predetermined crystal orientation. Thereafter, the workpiece is attached to the workpiece feed table, and the slicing of the workpiece is started.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
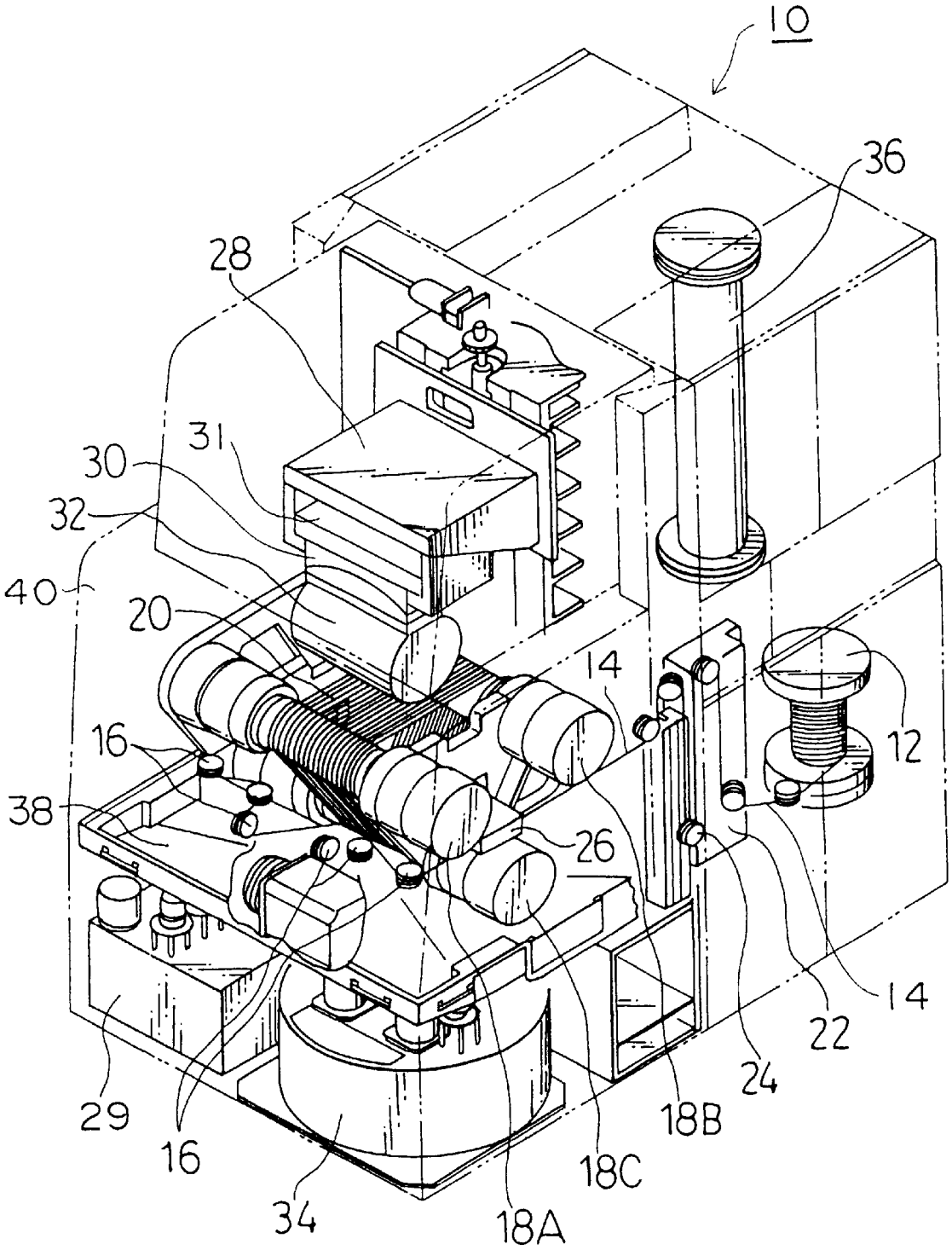
FIG. 1 is a perspective diagram of a wire saw according to the present invention.

FIG. 1 is a perspective diagram illustrating a wire saw 10 according to an embodiment of a wire saw in a workpiece slicing method according to the present invention.

As depicted in FIG. 1, a wire 14 wound around a wire reel 12 is wound on three grooved rollers 18A, 18B and 18C via a wire passage which is formed by a number of guide rollers 16, 16, . . . , so that a horizontal wire row 20 can be formed. The wire 14 forming the wire row 20 is taken up by a wire reel (not shown) via the other wire passage which is symmetrical to the above-mentioned wire passage across the wire row 20.

There are provided wire guiding equipment 22, dancer rollers 24 and wire cleaning equipment 26 on the wire passages which are formed at both sides of the wire row 20 (only one side is illustrated), and the wire guiding equipment 22 guides the wire 14 from the wire reel 12 at a constant pitch. A weight of a predetermined weight (not shown) is provided at the dancer roller 24 so as to apply constant tension to the running wire 14. The wire cleaning equipment 26 jets cleaning liquid supplied from a cleaning liquid tank 29 to the wire 14, so that slurry which has adhered to the wire 14 can be removed from the wire 14.

A motor which is rotatable forward and backward (not shown) connects to the pair of wire reels 12 and the grooved roller 18C. When the motor is driven, the wire 14 runs back and forth at a high speed between the pair of wire reels 12.

A workpiece feed table 28 is disposed above the wire row 20, and the workpiece feed table 28 moves up and down vertically with respect to the wire row 20. A tilting unit 30 is removably attached to the workpiece feed table 28 via a setting base 31. An ingot 32 is supported by the bottom of the tilting unit 30, and the ingot 32 is tilted at a predetermined angle. A detailed explanation will be given later about the construction of the tilting unit 30 and the setting base 31.

In order to slice the ingot 32 by the wire saw 10, the workpiece feed table 28 moves down toward the wire row 20, and the ingot 32 is pressed against the wire row 20 which is running at a high speed. In this case, the slurry is supplied to the wire row 20 from a slurry tank 34 via a nozzle (not shown), and the ingot 32 is sliced into wafers by the lapping operation of abrasive grains in the slurry.

The slurry used for processing the ingot 32 is collected into the slurry tank 34 via an oil pan 38 which is disposed below the wire row 20. The slurry is circulated and reused while a deficiency is supplied. In this case, the slurry absorbs the heat generated during the processing, and thereby the temperature of the slurry rises. A heat exchanger 36 cools the collected slurry to a predetermined temperature.

Next, an explanation will be given about the installment relation between the setting base 31 and the tilting unit 30 with reference to FIG. 3.

Figure 3:
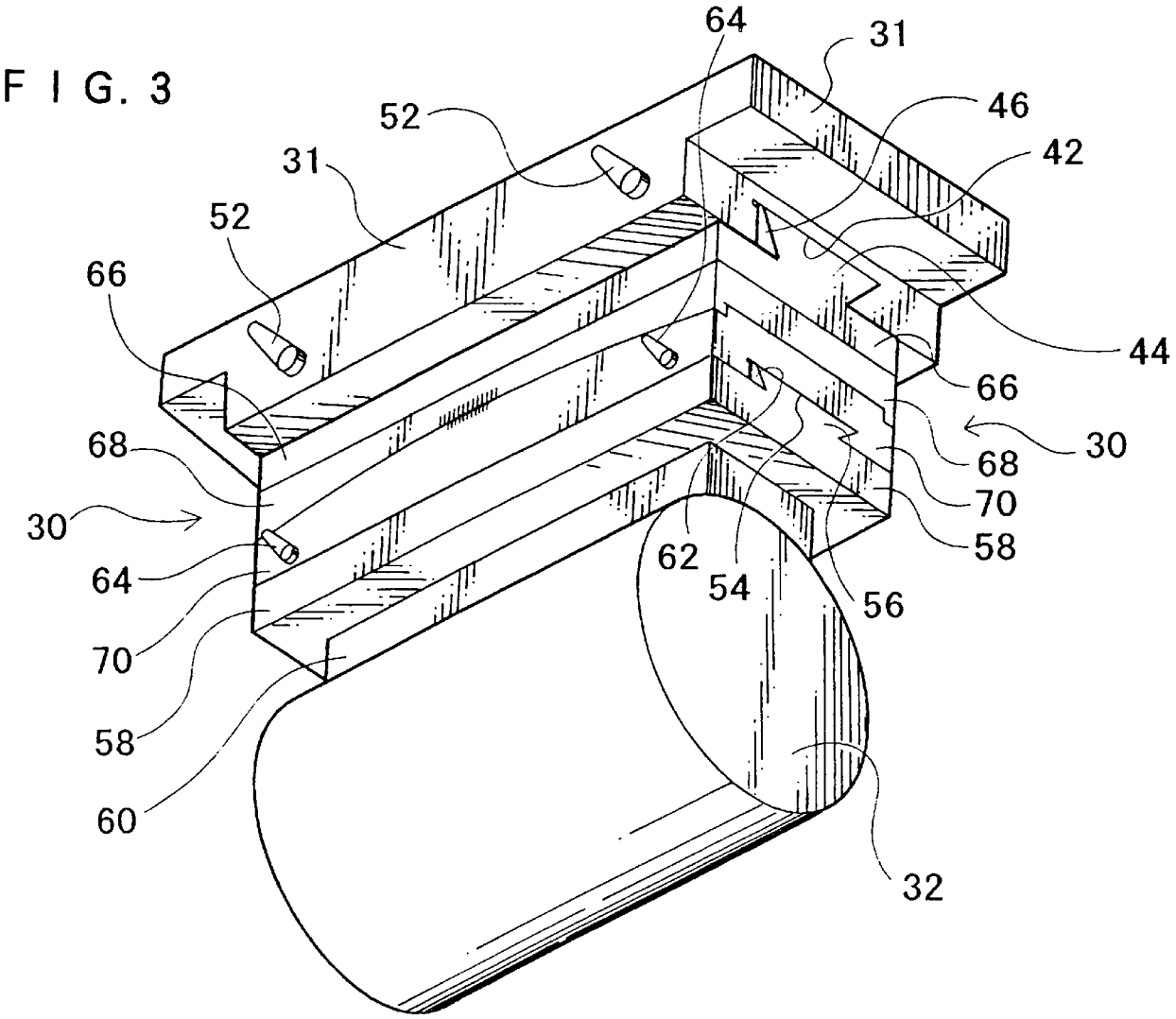
FIG. 3 is a perspective view illustrating a state where the ingot is mounted.

As depicted in FIG. 3, a dovetail 44, which is formed at the top of the tilting unit 30, is inserted into a dovetail groove 42 formed at the bottom of the setting base 31 so that the tilting unit 30 can be mounted on the setting base 31.

Figure 4:
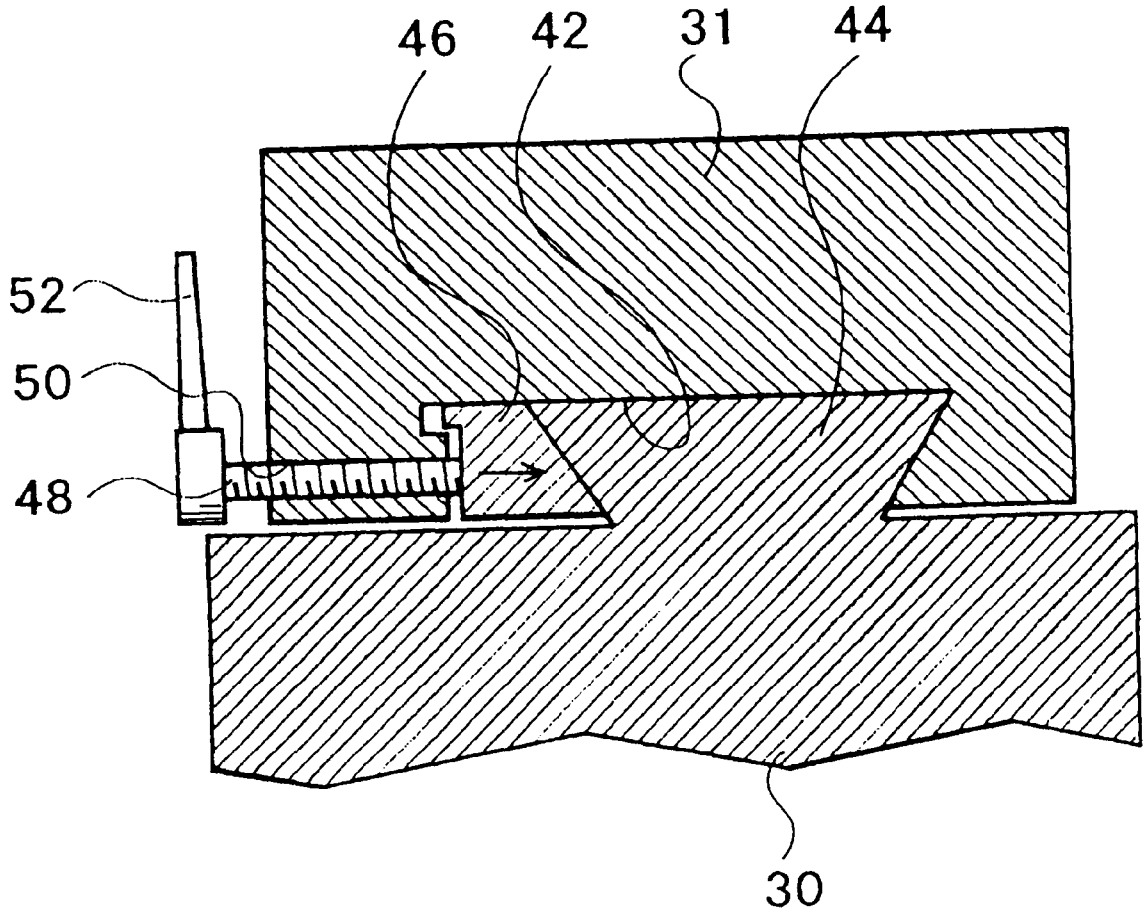
FIG. 4 is a partial sectional view illustrating a state where a setting base is coupled to a tilting unit.

As depicted in FIG. 4, a pressure plate 46, of which section is wedge-shaped, is disposed between the dovetail groove 42 and the dovetail 44. The pressure plate 46 is pivotally supported by one end of a threaded rod 48, which is engaged with a threaded hole 50 formed at the setting base 31. A lever 52 is secured to the other end of the threaded rod 48, and when the lever 52 is rotated, the pressure plate 46 moves forward and backward with respect to the dovetail 44.

According to the above-described construction, the lever 52 is rotated to move the pressure plate 46 in a direction of an arrow in FIG. 4 so that the dovetail 44 can be pressed tightly between the dovetail groove 42 and the pressure plate 46. Thereby, the tilting unit 30 is fixed on the setting base 31.

Next, an explanation will be given about the installment relation between the tilting unit 30 and the ingot 32 with reference to FIG. 3.

As depicted in FIG. 3, the ingot 32 is fixed to the bottom of a mounting plate 58 via a slice base mounting beam 60. A dovetail 56, which is formed at the top of the mounting plate 58, is inserted into a dovetail groove 54 formed at the bottom of the tilting unit 30 so that the mounting plate 58 can be mounted on the tilting unit 30.

A pressure plate 62, of which section is wedge-shaped, is disposed between the dovetail groove 54 and the dovetail 56, and when a lever 64 is rotated, the pressure plate 62 presses tightly the dovetail 56 or stops pressing the dovetail 56. Because the pressure plate 62 has the same mechanism as one in FIG. 4, an explanation on it will be omitted.

Figure 5:
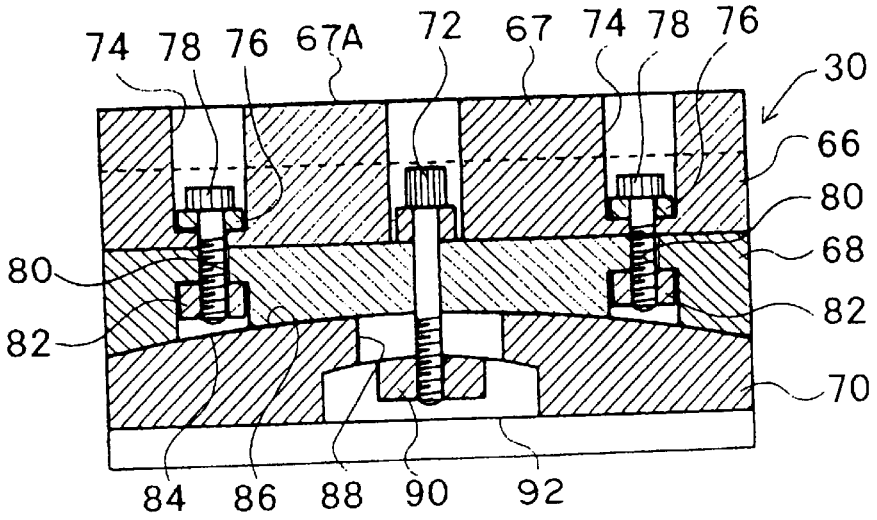
FIG. 5 is a longitudinal sectional view of the tilting unit.
Figure 6:
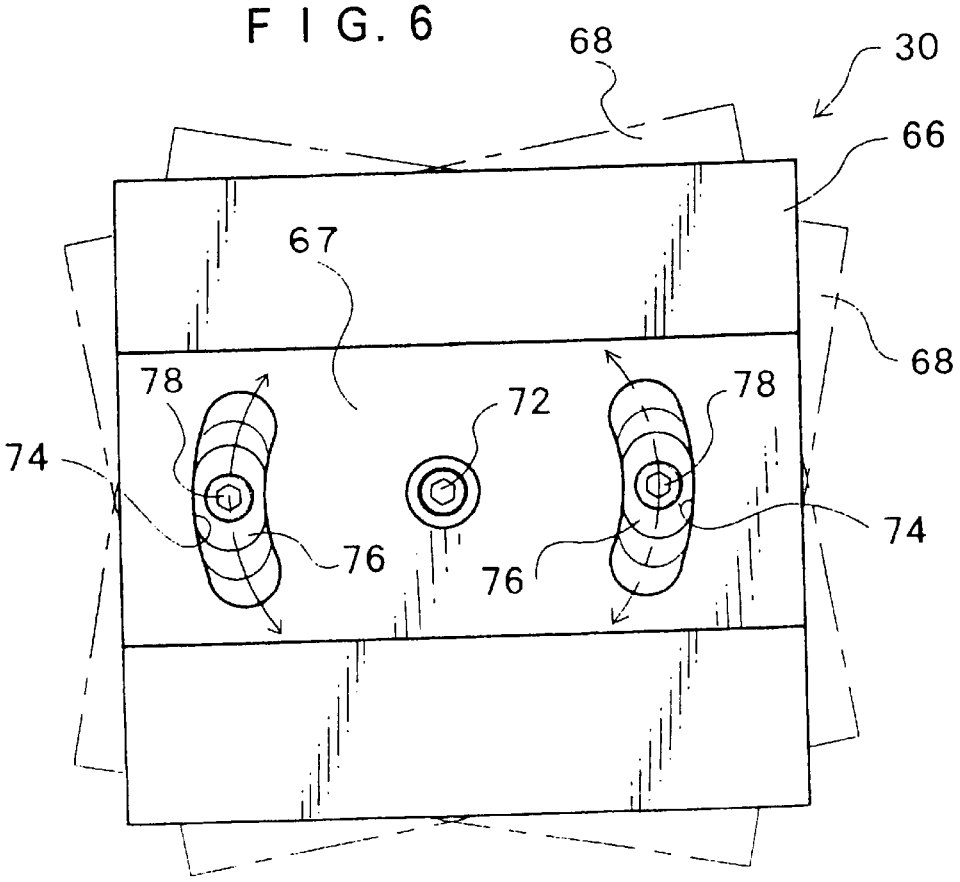
FIG. 6 is a plan view of the tilting unit.

Next, an explanation will be given about the construction of the tilting unit 30 with reference to FIGS. 5 and 6. FIG. 5 is a longitudinal sectional view of the tilting unit 30, and FIG. 6 is a plan view thereof.

As illustrated in FIG. 5, the tilting unit 30 is composed mainly of an installing block 66, a horizontal swinging block 68 and a vertical swinging block 70, which are integrated via a bolt 72 and bolts 78, 78.

The installing block 66 is rectangular, and the dovetail 44 is formed at the top of the installing block 66. As shown in FIG. 6, arched guide holes 74, 74, are formed symmetrically with respect to the bolt 72. Guide members 76, 76 are inserted into the guide holes 74, 74, and the guide members 76, 76 are formed to be slidable along the guide holes 74, 74. Bolt holes are formed at the center of the guide members 76, 76, and bolts 78, 78 are inserted into the bolt holes. The bolts 78, 78 are engaged with nuts 82, 82 via through holes 80, 80 of the horizontal swinging block 68.

According to the above-described construction, the horizontal swinging block 68 slides on the bottom of the installing block 66. When the bolts 78, 78 are tightened, the horizontal swinging block 68 is fixed to the installing block 66, and when the bolts 78, 78 are loosened, the horizontal swinging block 68 can swing horizontally around the bolt 72.

A concave curved face 84 is formed at the bottom of the horizontal swinging block 68. A convex curved face 86 is formed at the top of the vertical swinging block 70, and the convex curved face 86 is curved along the concave curved face 84. An elongate hole 88, which is arched along the curved face 86, is formed at the center of the top of the vertical swinging block 70. The bolt 72 is inserted into the elongate hole 88, and the bolt 72 is engaged with a nut 90.

According to the above-described construction, the vertical swinging block 70 slides on the concave curved face 84 of the horizontal swinging block 68. When the bolt 72 is tightened, the vertical swinging block 70 is fixed to the installing block 66, and when the bolt 72 is loosened, the vertical swinging block 70 can swing vertically. The dovetail groove 54 is formed at the bottom of the vertical swinging block 70.

Next, an explanation will be given about a procedure for adjusting the cutting direction of the ingot 32 by the tilting unit 30.

The crystal orientation of the ingot 32 is determined in advance by an X-ray crystal orientation determining equipment. In order to slice the ingot 32 based on the determined crystal orientation, the tilting unit 30 tilts the ingot 32 by predetermined tilt angles in horizontal and vertical directions with respect to the wire row 20.

First, the dovetail 56 of the mounting plate 58 to which the ingot 32 is fixed is inserted into the dovetail groove 54 of the tilting unit 30. Then, the levers 64 are rotated to fix the ingot 32 on the tilting unit 30.

Then, the bolt 72 and the bolts 78, 78 are loosened so that the horizontal swinging block 68 and the vertical swinging block 70 can swing with respect to the installing block 66.

Next, the horizontal swinging block 68 is swung horizontally, and when the ingot 32 is tilted horizontally by the predetermined horizontal tilt angle, the bolts 78 are tightened to fix the horizontal swinging block 68 on the attaching block 66.

Then, the vertical swinging block 70 is swung vertically with respect to the horizontal swinging block 68, and when the ingot 32 is tilted vertically by the predetermined vertical tilt angle, the bolt 72 is tightened to fix the vertical swinging block 70 to the attaching block 66. Thereby, the adjustment of the cutting direction of the ingot 32 is completed.

Next, an explanation will be given about a procedure for installing the ingot 32, of which tilt angles have already been adjusted, on the workpiece feed table 28 shown in FIG. 1.

First, as depicted in FIG. 3, the tilting unit 30 in which the tilt angles of the ingot 32 have already been adjusted is fixed to the setting base 31.

Figure 2:
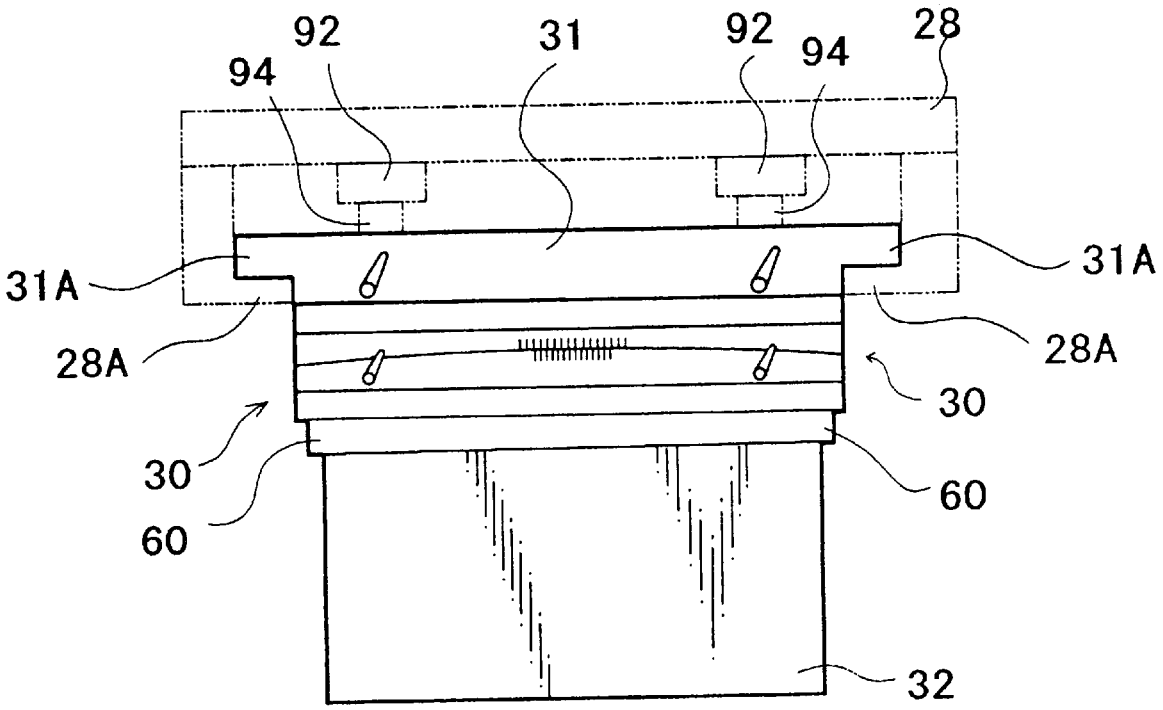
FIG. 2 is a front view illustrating a state where an ingot is mounted.

Next, as depicted in FIG. 2, the setting base 31 is transferred to the position of the workpiece feed table 28, and shoulders 31A, 31A, which are formed at both ends of the setting base 31, are placed on workpiece holding parts 28A, 28A of the workpiece feed table 28. Then, rods 94, 94 of hydraulic cylinders 92, 92 provided on the workpiece feed table 28 are extended so as to pinch the shoulders 31A, 31A between the workpiece holding parts 28A, 28A and the rods 94, 94 so that the shoulders 31A, 31A can be fixed. Thereby, the installment of the ingot 32 is completed.

In order to cut the ingot 32 into wafers, the workpiece feed table 28 is fed towards the wire row 20, and the ingot 32 is pressed against the wire row 20.

As stated above, according to the workpiece cutting method of the wire saw in this embodiment, the horizontal and vertical tilt angles of the ingot 32 are adjusted in advance at the outside of the wire saw 10, and then the ingot 32 is attached to the workpiece feed table 28 and is sliced. Thereby, the wire saw 10 can operate efficiently.

That is, while the ingot is sliced, tilt angles of an ingot to be cut next can be adjusted in advance. Thus, it is possible to omit the tilting operation required in the past after the ingot 32 is mounted, and thereby the wire saw 10 can operate efficiently.

Moreover, since the tilting operation can be performed at the outside of the wire saw 10, the operation can be easier and safer than in the conventional adjustment of the tilt angles of the ingot at a high and narrow place.

Furthermore, since there is no need to equip the wire saw 10 with the tilting equipment, the construction of the wire saw 10 can be simple.

Next, a detailed explanation will be given about the second embodiment of the present invention.

In the workpiece slicing method according to the second embodiment of the present invention, the ingot 32 is positioned with respect to the slice base 60 and the setting base 31 in advance, and then the setting base 31, on which the ingot 32 is mounted, is fixed on the workpiece feed table 28 so that the ingot 32 can be sliced parallel to the wire row 20 and the sliced wafer can have a predetermined crystal orientation.

In order that the ingot 32 can be sliced parallel to the wire row 20 and the sliced wafer can have a predetermined crystal orientation, the cutting direction of the ingot 32 is adjusted by rotating the ingot 32 about an axis l thereof by a predetermined angle in the circumferential direction and rotating, parallel to the wire row 20, the ingot 32 about a center O thereof by a predetermined angle.

Suppose that horizontal and vertical references of the ingot 32 (an orientation flat of the ingot 32 is the horizontal reference, and a plane, which includes the axis l of the ingot 32 and is perpendicular to the orientation flat, is the vertical reference) correspond to horizontal and vertical references of the wire row 20 (a wire row plane, which is formed by the wire row 20, is the horizontal reference, and a plane, which includes a center line of the wire row plane and is perpendicular to the wire row plane, is the vertical reference).

In order that the ingot 32 can be sliced parallel to the wire row 20 and the sliced wafer can have a predetermined crystal orientation, an angle $\theta$ at which the ingot 32 is rotated about the axis l thereof in the circumferential direction and an angle $\lambda$ at which the ingot 32 is rotated about the center O thereof are given by $$\theta=\tan^{-1}(\tan\beta/\tan\alpha)$$

$$\lambda=\tan^{-1}(\tan\alpha/\cos\theta)$$

where $\alpha$ and $\beta$ are the vertical and horizontal tilt angles of the axis of the ingot 32, respectively, which are determined by the X-ray crystal orientation determining equipment.

Thus, in order that the ingot 32 can be sliced parallel to the wire row 20 and the face of the sliced wafer can be a predetermined crystal face, the ingot 32 is rotated about its axis by $\theta$ in the circumferential direction and is rotated about the axis perpendicular to the axis of the ingot 32 and perpendicular to the wire row plane 20 by $\lambda$ in a parallel motion with the wire row 20, from the state where the vertical and horizontal references of the ingot 32 correspond to the vertical and horizontal references of the wire row 20, so as to be positioned and fastened on the slice base mounting beam 60 and the setting base 31, and the positioned and fastened ingot 32 is fixed to the workpiece feed table 28.

Figure 7:
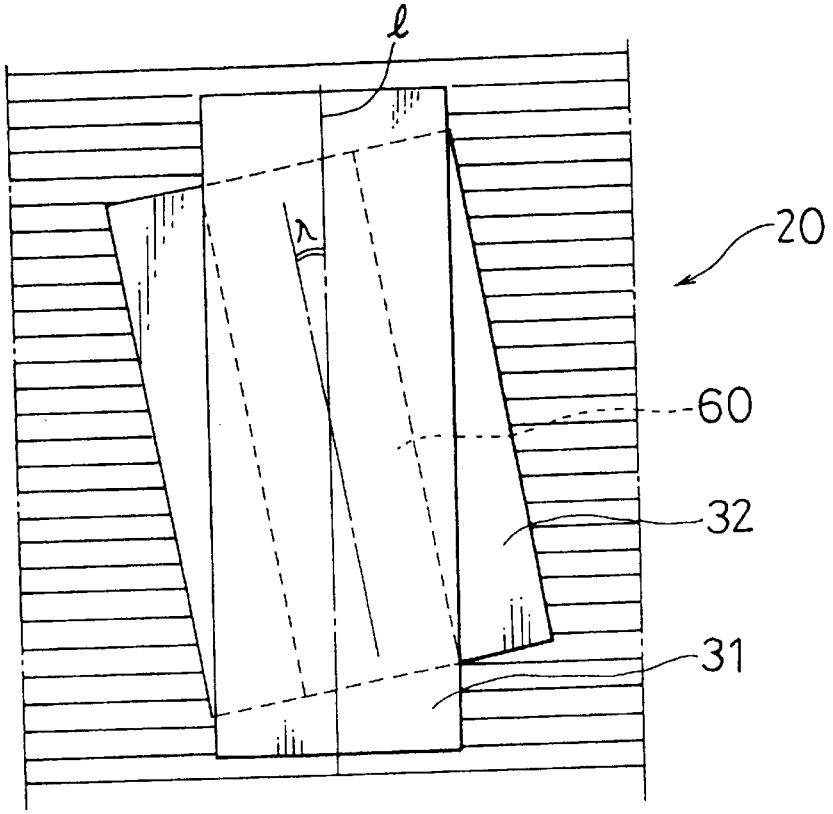
FIGS. 7(*a*) and 7(*b*) are views describing the second embodiment of a workpiece slicing method of the wire saw according to the present invention.
Figure 7:
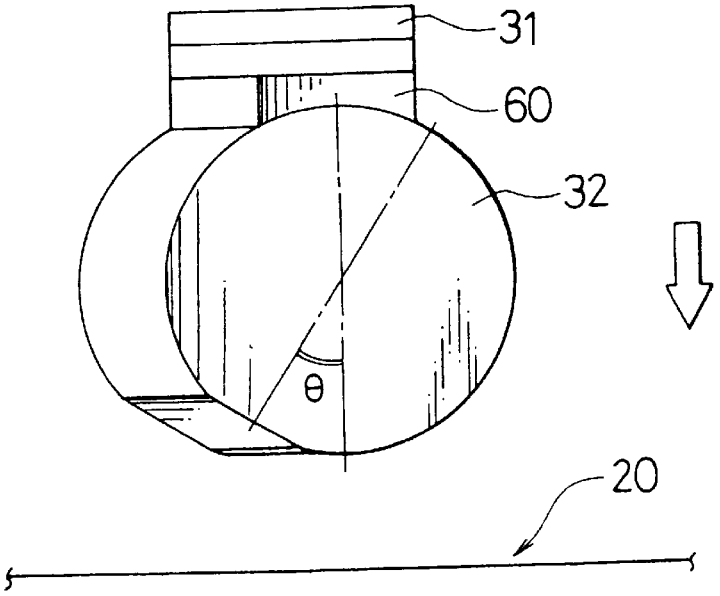

In FIGS. 7(*a*) and 7(*b*), the ingot 32 is rotated about its axis by $\theta$ and is rotated by $\lambda$ parallel with the wire row 20 from the state where the vertical and horizontal references of the ingot 32 correspond to the vertical and horizontal references of the wire row 20, and the ingot 32 is fixed to the slice base 60, the setting base 31 and the workpiece feed table (not shown). The ingot 32 is sliced parallel to the wire row 20 in the above-stated state so that the sliced wafers have the predetermined crystal orientation.

Thus, in the slicing method of the second embodiment, the horizontal and vertical tilt angles of the ingot 32 are adjusted in advance at the outside of the wire saw 10, and then the ingot 32 is attached to the workpiece feed table 28 and is sliced. Thereby, the slicing efficiency can be improved as is the case in the previously-described first embodiment.

Furthermore, according to the slicing method of the second embodiment, since the ingot 32 can be sliced parallel to the wire row 20, the heat generated in the grooved rollers 18A, 18B and 18C forming the wire row 20 can be even. Thereby, the slicing can be accurately performed.

Next, an explanation will be given about the third embodiment of the present invention.

In the first embodiment, in order to set the tilt angles of the ingot 32, the vertical and horizontal tilt angles of the ingot 32 are adjusted based on the previously-determined crystal orientation of the ingot 32. This method, however, has a disadvantage because, if an error takes place when the ingot 32 is mounted on the slice base mounting beam 60, the error will not be noticed, and thereby inferior wafers will be manufactured.

In the third embodiment, the crystal orientation of the ingot 32 is determined and the cutting direction of the ingot 32 is adjusted in a manner described below in order to solve the above-stated problem.

Figure 8:
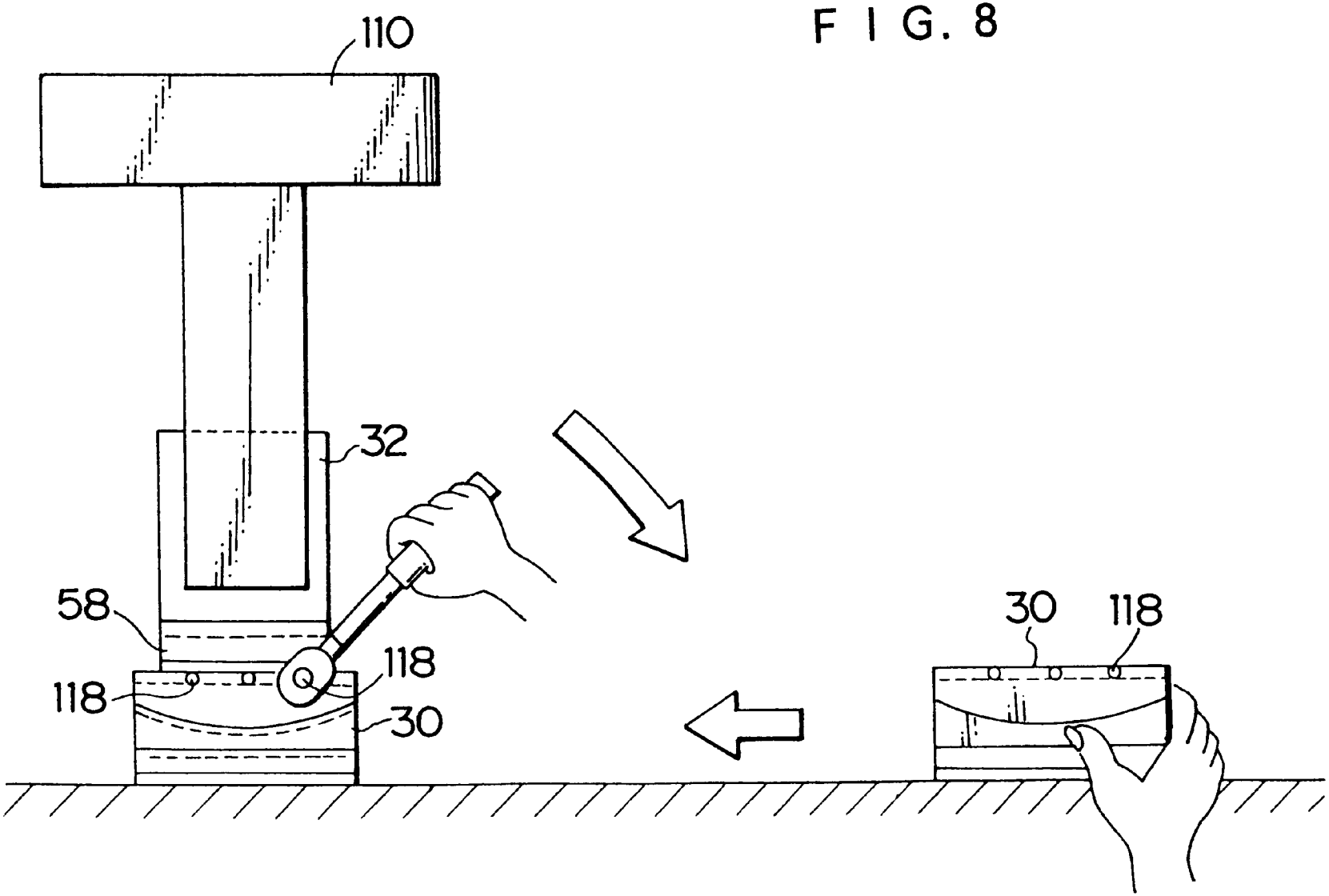
FIG. 8 is a view describing a state where the ingot is fixed on the tilting unit via a mounting plate.

First, as indicated in FIG. 8, a manipulator 110 holds the ingot 32, and the tilting unit 30 is fixed to the mounting plate 58 attached to the side of the ingot 32. The tilting unit 30 is coupled to the mounting plate 58 via the dovetail groove and the dovetail (not shown), and the tilting unit 30 is fastened on the mounting plate 58 by screws 118.

Figure 9:
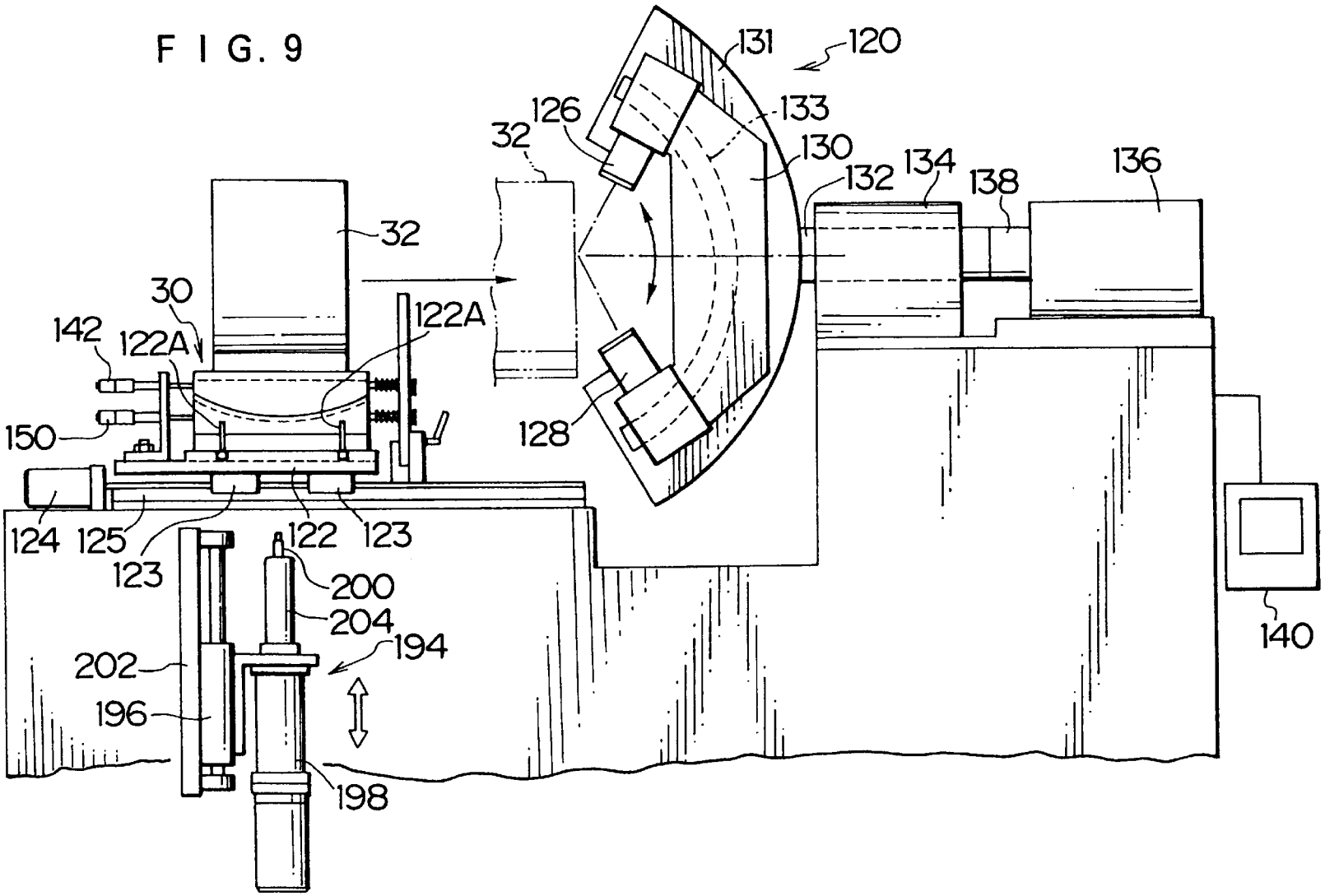
FIG. 9 is a side view of an X-ray crystal orientation determining equipment according to an embodiment of the present invention.

FIG. 9 illustrates an X-ray crystal orientation determining equipment 120 provided with a slide table 122, which is movable to the right and left on guides 123 and a rail 125. When a threaded rod (not shown) connected to a motor 124 is rotated, the slide table 122 is driven to the right and left.

The ingot 32 with the tilting unit 30 is placed on the slide table 122 by the manipulator 110. The tilting unit 30 is coupled to the slide table 122 via the dovetail groove and the dovetail (not shown), and is fastened by levers 122A.

The X-ray crystal orientation determining equipment 120 has an X-ray projecting part 126 and an X-ray receiving part 128. The X-ray projecting part 126 is supported by one end of an arm 130, and the X-ray receiving part 128 is supported by the other end of the arm 130. The axes of the X-ray projecting part 126 and the X-ray receiving part 128 meet at a predetermined angle. The arm 130 is swingably supported by a fan-shaped plate 131 via an arched rail 133. A rotational shaft 132 is fixed to the plate 131, and the rotational shaft 132 connects to a spindle 138 of a motor 136 via a bearing 134. The motor 136 is controlled by a controller (not shown) so as to rotate the arm 130 by 90° per rotation.

The X-ray projecting part 126 and the X-ray receiving part 128 swing on a guide (not shown) and the rail 133 by a screw feeding mechanism and a motor (not shown).

When the X-ray crystal orientation determining equipment 120 determines the crystal orientation of the ingot 32, the ingot 32 with the tilting unit 30 is fixed to the slide table 122. Then, the slide table 122 is moved to the right in FIG. 9, and the ingot 32 is positioned at a determining position indicated by an alternate long and two short dashes line in FIG. 9. Next, the X-ray projecting part 126 projects the X-ray toward the cutting face of the ingot 32, and the X-ray receiving part 128 receives the reflected X-ray. The vertical component of the crystal orientation of the ingot 32 is determined based upon the reflection angle. Thereafter, the arm 130 is rotated by 90° by the motor 136, and the horizontal component of the crystal orientation of the ingot 32 is determined. Thus, the determination of the crystal orientation of the ingot 32 is completed. The determined vertical and horizontal components of the crystal orientation are displayed on a monitor 140.

Next, the slide table 122 is returned to its original position, and the tilting unit 30 adjusts the vertical and horizontal tilt angles of the ingot 32 based on that the determined crystal orientation of the ingot 32.

Figure 10:
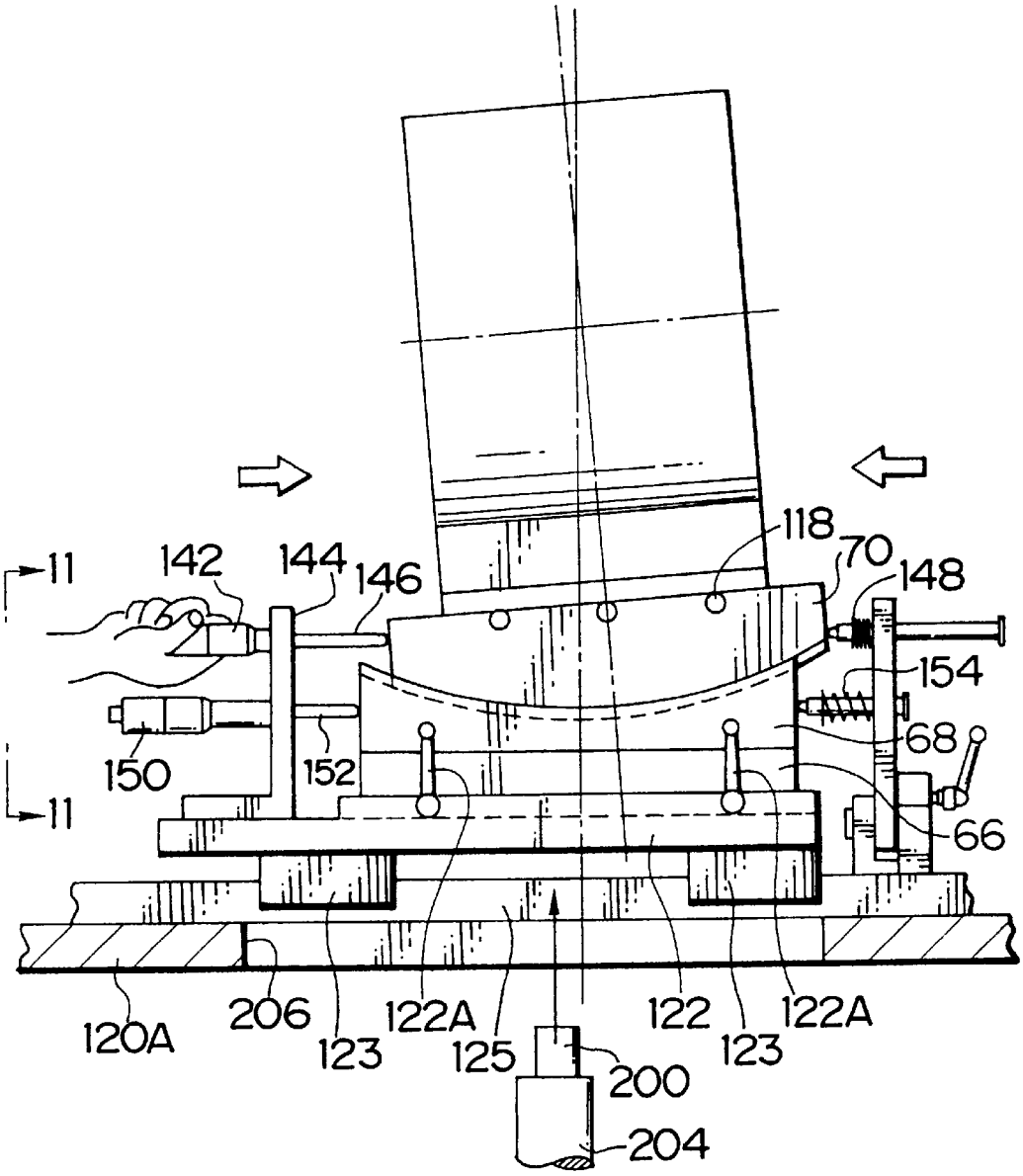
FIG. 10 is a front view of the tilting unit.
Figure 11:
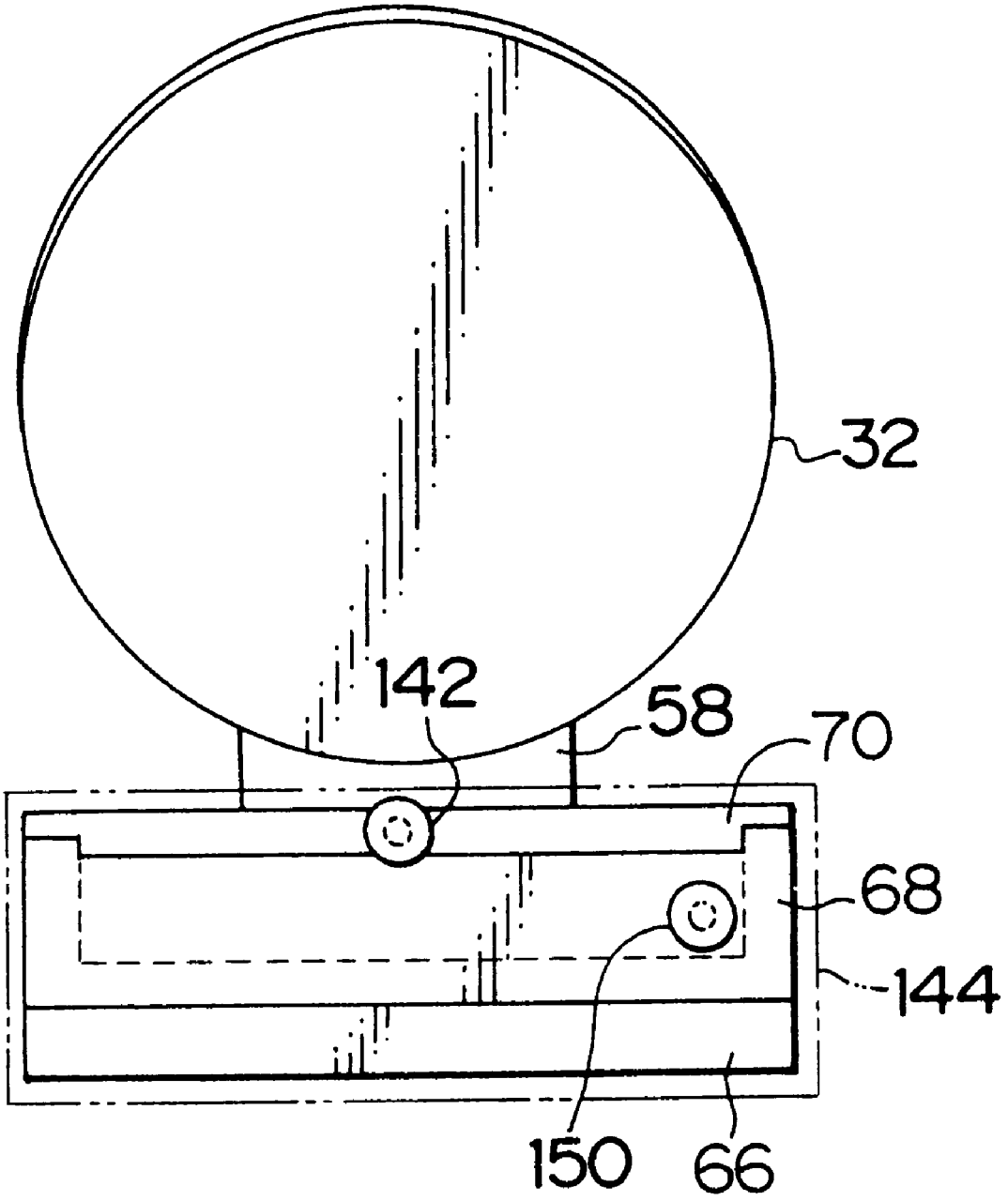
FIG. 11 is a view of the tilting unit taken on line 11—11 of FIG. 10.

First, the vertical tilt angle is adjusted by turning the head of a micrometer 142 shown in FIG. 10. The micrometer 142 is supported by a plate 144 fixed on the slide table 122. A push rod 146 connects to the spindle of the micrometer 142, and the push rod 146 moves to the right and left in the drawing along with the spindle when the micrometer 142 rotates. When the micrometer 142 moves the push rod 146 to the right in the drawing, the tip of the push rod 146 pushes the vertical swinging block 70 of the tilting unit 30. Thereby, the vertical swinging block 70 tilts vertically to the horizontal swinging block 68 against the force of a spring 148. The vertical tilt angle is adjusted based on the determined vertical component of the crystal orientation of the ingot 32. As indicated in FIG. 11, the micrometer 142 is provided at such a position as to push the center of the vertical swinging block 70.

Next, the horizontal tilt angle is adjusted by turning the head of a micrometer 150 shown in FIG. 10. The micrometer 150 is supported by the plate 144. A push rod 152 connects to the spindle of the micrometer 150, and the push rod 152 moves to the right and left in the drawing along with the spindle when the micrometer 150 rotates. When the micrometer 150 moves the push rod 152 to the right in the drawing, the tip of the push rod 152 pushes the horizontal swinging block 68 of the tilting unit 30. Thereby, the horizontal swinging block 68 rotates horizontally against the force of a spring 154, and the horizontal swinging block 68 tilts horizontally with respect to the installing block 66. The horizontal tilt angle is adjusted based on the determined horizontal component of the crystal orientation of the ingot 32. As indicated in FIG. 11, the micrometer 150 is provided at such a position as to push the area in a close proximity to the corner of the horizontal swinging block 68.

Next, the X-ray crystal orientation determining equipment 120 determines again the crystal orientation of the ingot 32 whose tilt angles have been adjusted, thus confirming whether the adjusted tilt angles are correct or not. If the tilt angles are not correct, the tilt angles are adjusted again as stated previously.

When the tilt angles of the ingot 32 are adjusted, the ingot 32 may be returned to its original position indicated by a solid line in FIG. 9, or the ingot 32 may be positioned at the determining position indicated by the alternate long and two short dashes line in the drawing. An error in the adjustment at the determining position is smaller than that in the adjustment at the original position.

Figure 12:
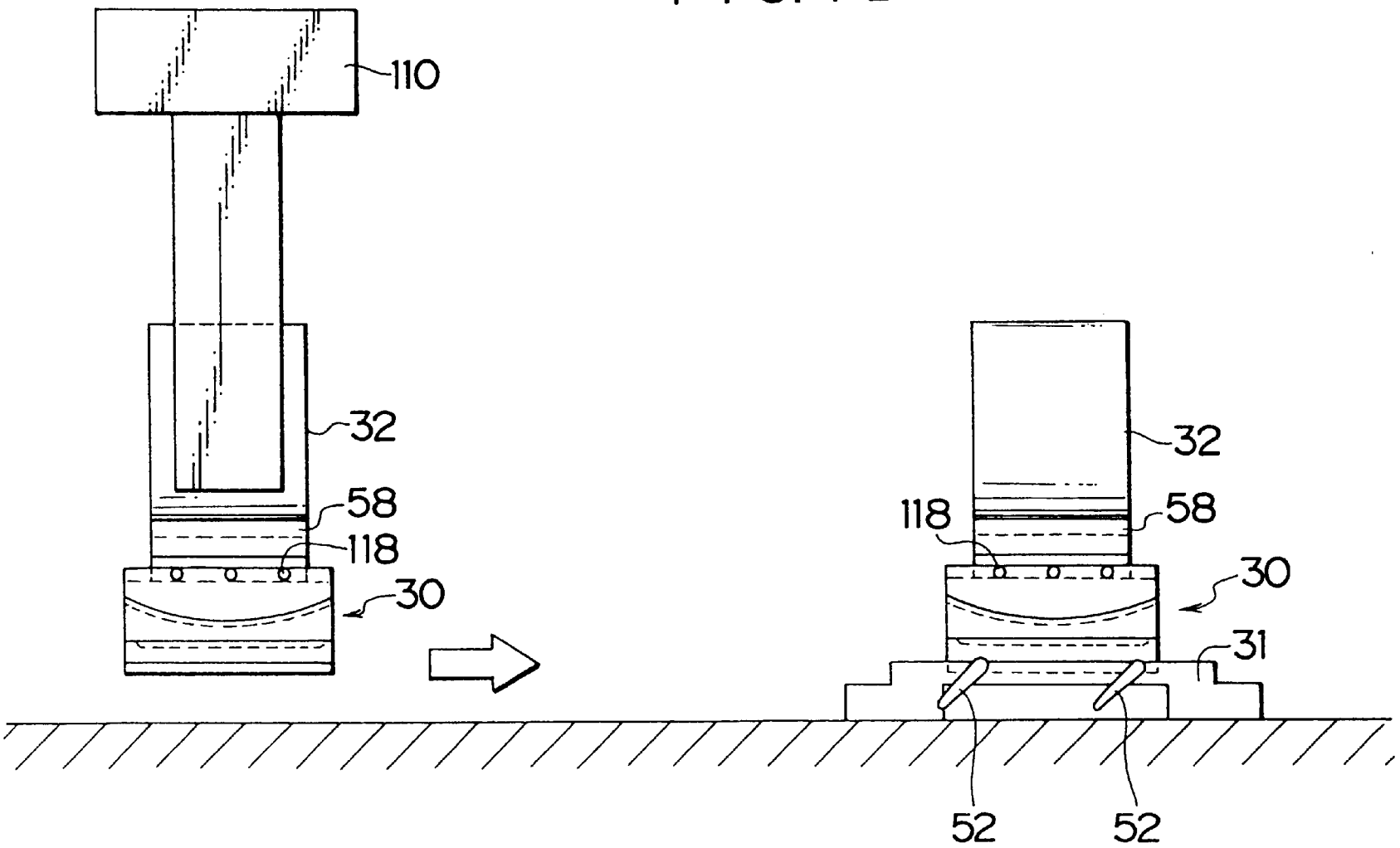
FIG. 12 is a view illustrating a state where the ingot is fixed on the setting base via the tilting unit.

If the tilt angles are confirmed to be correct, the ingot 32 is removed from the slide table 122 along with the tilting unit 30, and the ingot 32 is placed on the setting base 31 shown in FIG. 12 by means of the manipulator 110. The ingot 32 with the tilting unit 30 is mounted on the setting base 31, and the tilting unit 30 is fastened by the levers 52. Thereafter, the ingot 32 is transported to the wire saw by a transporting means or a conveyer (not shown). Then, the ingot 32 with the tilting unit 30 is fixed on the workpiece feed table of the wire saw via the setting base 31.

In this embodiment, the tilt angles of the ingot 32 are adjusted by turning the micrometers 142 and 150 shown in FIG. 10 by hand; however, the present invention should not be restricted to this. For example, stepping motors connect to the heads of the micrometers 142 and 150. Then, the rotational angle of the stepping motor is controlled according to the information indicating the crystal orientation of the ingot 32, which is determined by the X-ray crystal orientation determining equipment 120. The stepping motors rotate the heads of the micrometers 142 and 150 so that the tilt angles of the ingot 32 can be adjusted based on the crystal orientation found by the X-ray crystal orientation determining equipment 120. Thereby, the tilt angles of the ingot 32 can be adjusted automatically.

Since the tilting unit 30 in this embodiment has the same construction as the one in the first embodiment, the construction and operation of the tilting unit 30 will not be explained.

When the vertical swinging block 70 and the horizontal swinging block 68 are fixed in the tilting unit 30, the bolt 72 and the bolts 78, 78 must be tightened.

The tightening can be automatically performed by automatic bolt tightening equipment 194 provided in the X-ray crystal orientation determining equipment 120 shown in FIG. 9. The automatic bolt tightening equipment 194 has a cylinder 196, a motor 198, and a tightening member 200. The cylinder 196 is attached to a guide 202 in such a manner as to move up and down, and the cylinder 196 is controlled by a controller (not shown) in order to move upward and downward along the guide 202. The motor 198 is fixed to the cylinder 196, and the motor 198 is moved in connection with the upward and downward motion of the cylinder 196. The motor 198 is also controlled by the controller as is the case with the cylinder 196.

The tightening member 200 connects to the spindle 204 of the motor 198. When the cylinder 196 moves upward in the drawing, the tightening member 200 engages with the bolt 72 of the tilting unit 30 shown in FIG. 6 through an opening 206 formed at a casing 120A of the X-ray crystal orientation determining equipment 120 shown in FIG. 10. When the motor 198 is controlled to rotate forward, the bolt 72 is tightened, and when the motor 198 is controlled to rotate backward, the bolt 72 is loosened. The automatic bolt tightening equipment 194 is moved horizontally to a position corresponding to the positions of the bolts 78, 78 by a horizontal moving equipment (not shown) so that the tightening member 200 can also engage with the bolts 78, 78 of the tilting unit 30. Thereby, the automatic bolt tightening equipment 194 tightens and loosens the bolts 78, 78.

The adjustment of the tilt angles of the ingot 32 by the X-ray crystal orientation determining equipment can be completely automated by using and controlling both the automatic bolt tightening equipment 194 and the stepping motors.

With reference to FIG. 9, the motor 124 is controlled so as to position the ingot 32 at the determining position, and then the X-ray projecting part 126, the X-ray receiving part 128 and the motor 136 are controlled to determine the crystal orientation of the ingot 32. Then, the motor 124 is controlled to return the ingot 32 to its original position, and the stepping motors are controlled based on the determined crystal orientation of the ingot 32. Thereby, the micrometers 142 and 150, which connect to the stepping motors, rotate, and the blocks 68 and 70 of the tilting unit 30 tilt, so that the tilt angles of the ingot 32 can be automatically adjusted. Then, the automatic bolt tightening equipment 194 tightens the bolts 72, 78, 78 of the tilting unit 30. Thus, the adjustment of the tilt angles of the ingot 32 is automatically completed.

Next, an explanation will be given about the fourth embodiment of the present invention.

The wire saw in the fourth embodiment is able to slice a plurality of ingots at the same time.

Figure 13:
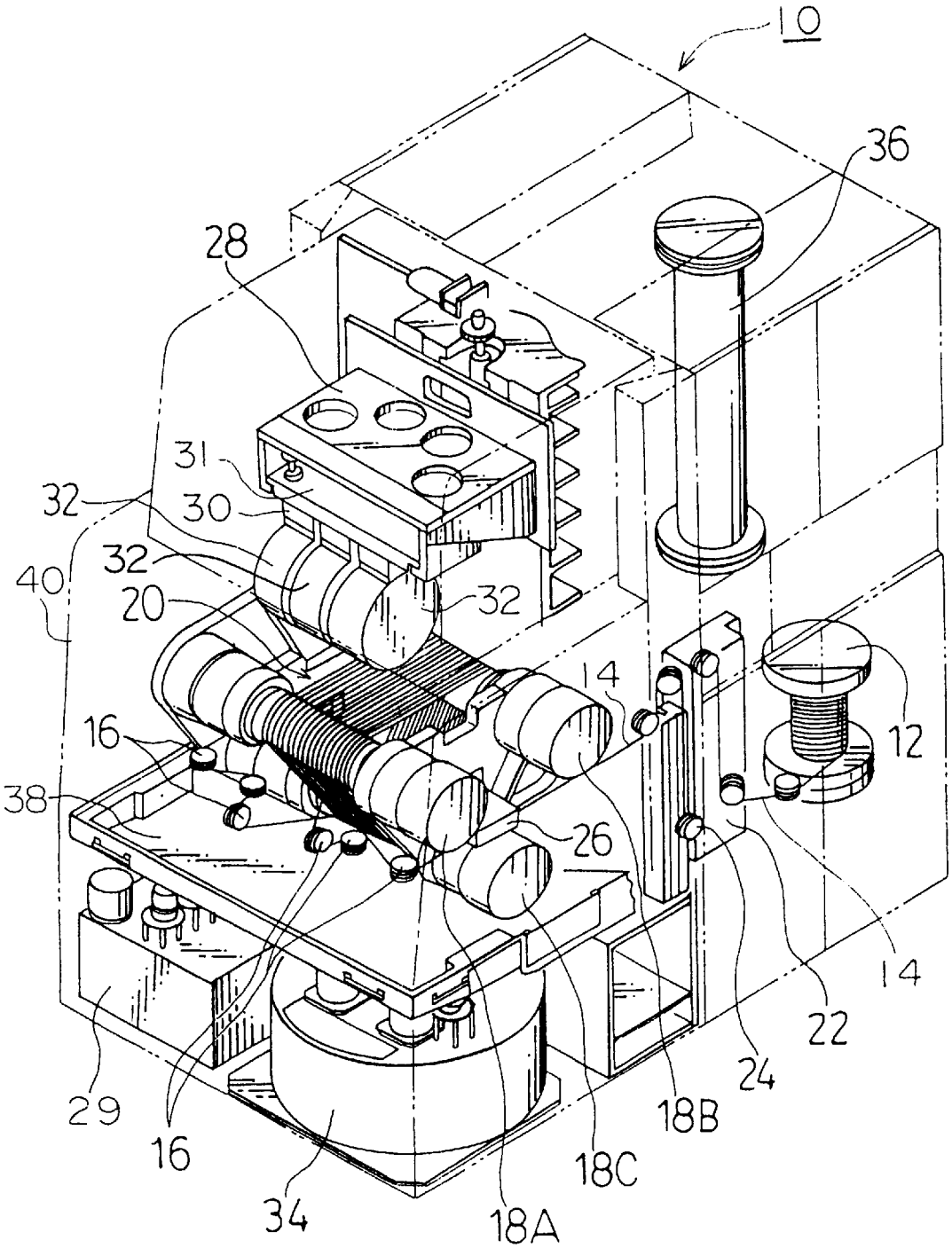
FIG. 13 is a perspective diagram of the wire saw according to the fourth embodiment of the present invention.
Figure 14:
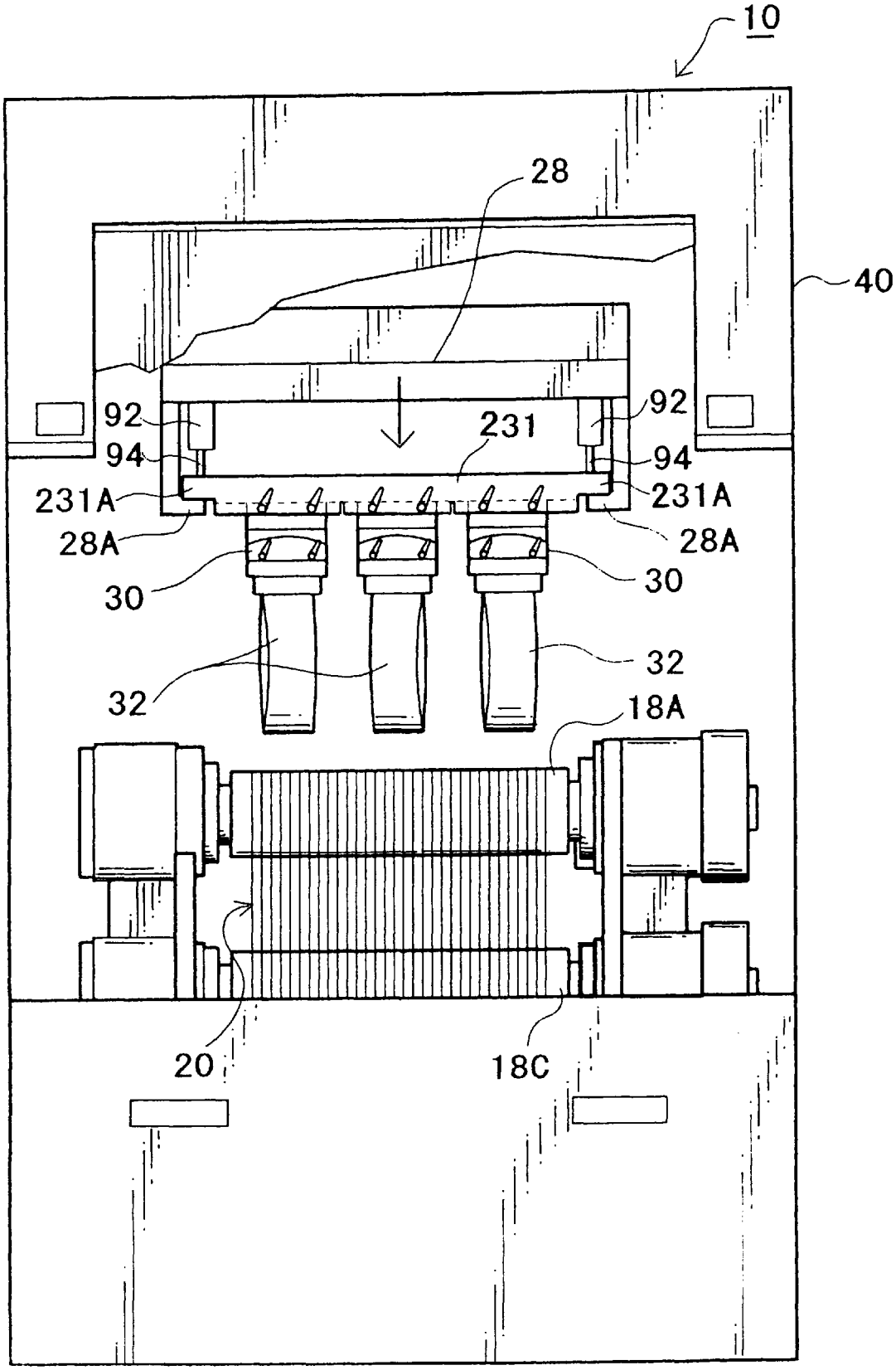
FIG. 14 is a front view of the wire saw of FIG. 13.

That is, as depicted in FIGS. 13 and 14, three ingots 32 are attached to the workpiece feed table 28. These three ingots 32 are removably attached to the workpiece feed table 28 via three tilting units 30, and the ingots 32 are respectively supported by the tilting units 30 in such a manner as to tilt at predetermined tilt angles.

Since the construction of the wire saw itself is the same as in the first embodiment, the components of the wire saw are denoted by the same reference numerals, and they will not be described.

An explanation will hereunder be given about the relation between the ingot 32 and the tilting unit 30 when the ingot 32 is attached to the tilting unit 30.

Figure 15:
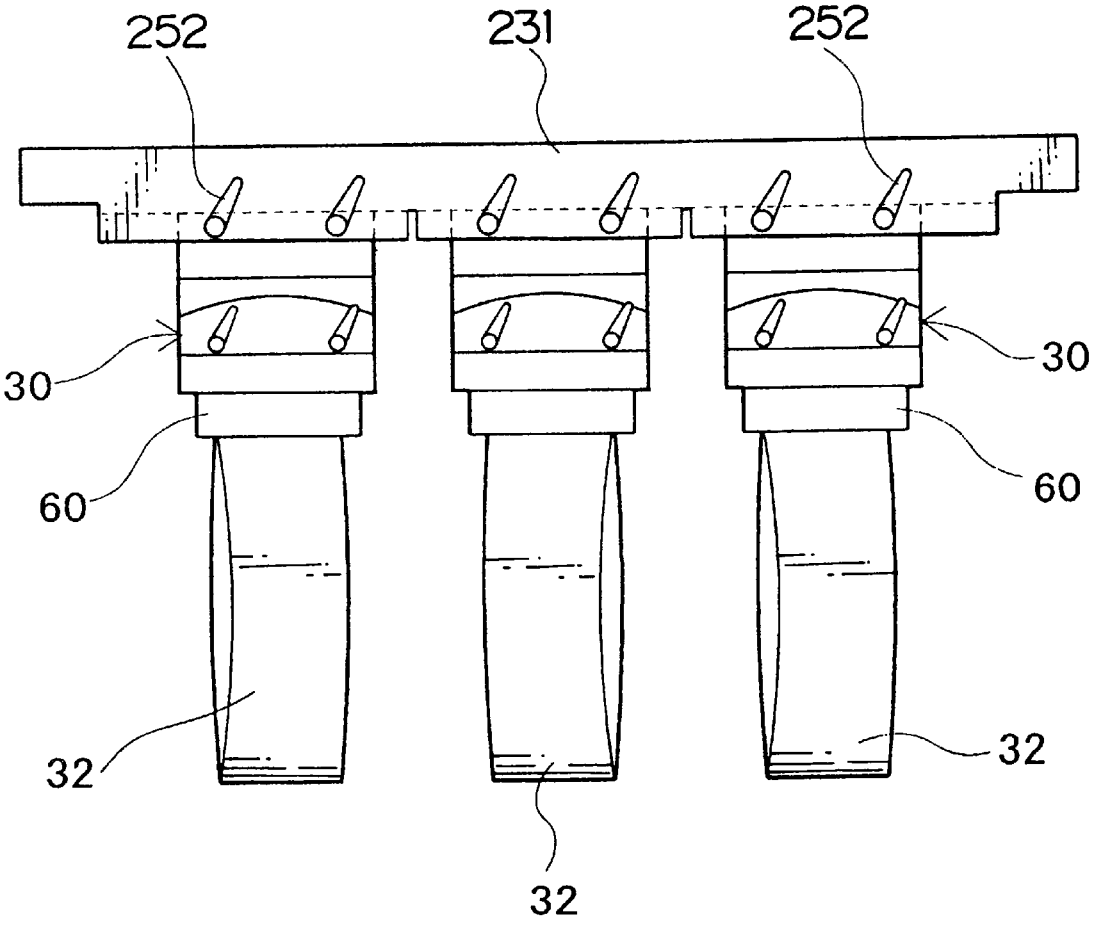
FIG. 15 is a front view illustrating a state where the ingots are fixed on the setting base via the tilting units.
Figure 16:
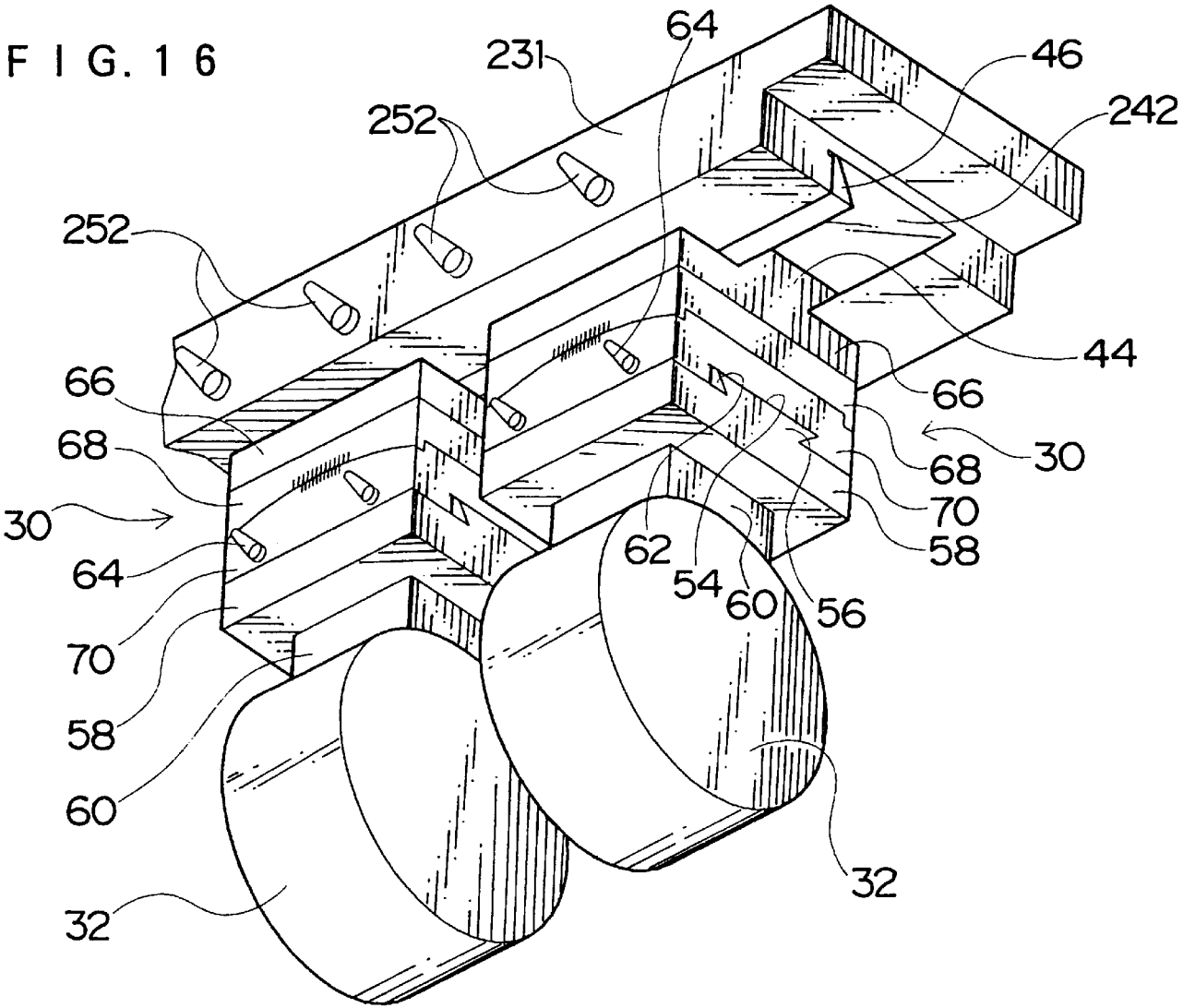
FIG. 16 is a perspective view illustrating the essential portions in FIG. 15.

FIG. 15 is a front view illustrating the state where the ingots 32 are attached to the setting base 231 via the tilting units 30, and FIG. 16 is a partially perspective view of FIG. 15.

As shown in FIG. 16, the tilting unit 30 is mounted on the setting base 231 by inserting the dovetail 44 formed at the top of the tilting unit 30 into a dovetail groove 242, which is formed in the longitudinal direction at the bottom of the setting base 231.

Figure 17:
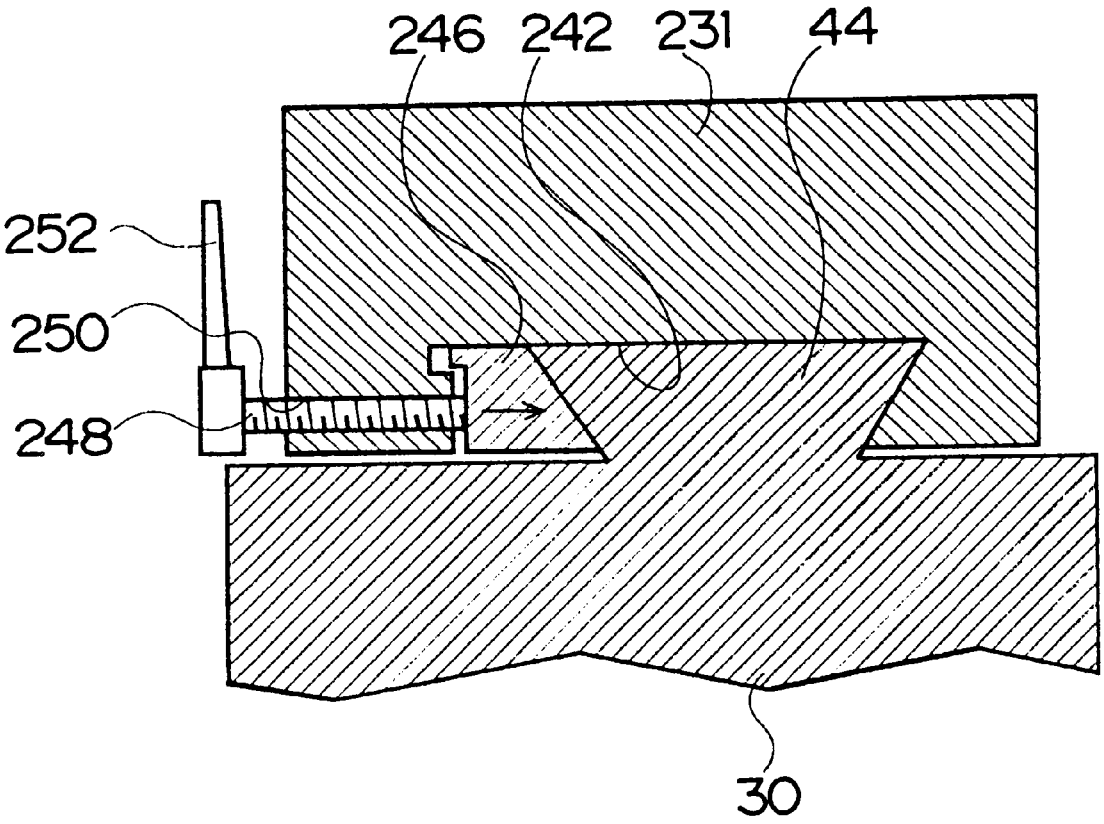
FIG. 17 is a partial sectional view illustrating a state where the setting base is coupled to the tilting unit.

As depicted in FIG. 17, a pressure plate 246, whose section is wedge-shaped, is arranged between the dovetail grove 242 and the dovetail 44. The pressure plate 246 is pivotally supported by one end of a threaded rod 248, and the threaded rod 248 is engaged with a threaded hole 250 formed at the setting base 231. A lever 252 is secured to the other end of the threaded rod 248, and the lever 252 is rotated to move the pressure plate 246 forward and backward with respect to the dovetail 44.

According to the above-stated construction, when the lever 252 is rotated to move the pressure plate 246 in a direction of an arrow in FIG. 17, the dovetail 44 is pressed tightly between the dovetail groove 42 and the pressure plate 46. Thereby, the tilting unit 30 is fixed on the setting base 231.

When the lever 252 is rotated in reverse direction, the pressure plate 246 moves out of the dovetail 44, and the pressing force is released. If the tilting unit 30 is moved along the dovetail groove 242 at that time, the position of the tilting unit 30 with respect to the setting base 231 can be changed.

As depicted in FIG. 16, the dovetail 56 is formed at the top of the mounting plate 58, and the slice base mounting beam 60 of the ingot 32 is secured to the bottom of the mounting plate 58, so that the ingot 32 can be supported by the mounting plate 58. The dovetail 56 is inserted into the dovetail groove 54 which is formed at the bottom of the tilting unit 30 in the longitudinal direction, so that the ingot 32 can be mounted on the tilting unit 30.

The pressure plate 62, whose section is wedge-shaped, is arranged between the dovetail groove 54 and the dovetail 56. The pressure plate 62 is used for pressing the dovetail 56 or not pressing the dovetail 56 by the rotation of the lever 64. Since the pressure plate 62 has the same mechanism as the one in FIG. 17, it will not be described in detail.

Since the tilting unit 30 is constructed in the same manner as the one in the first embodiment, it will not be explained.

An explanation will hereunder be given about a procedure for attaching the three ingots 32 to the setting base 231 and attaching the setting base 231 to the workpiece feed table 28 shown in FIGS. 14 and 15.

The three ingots 32 having different crystal orientations are respectively attached to the tilting units 30. Then, the tilt angles of the ingots 32 adjusted by the tilting unit 30.

Next, the tilting units 30 which have adjusted the tilt angles are fixed on the setting base 231 at regular intervals (see FIG. 16). Then, the setting base 231 is transferred to the position of the workpiece feed table 28. Shoulders 231A formed at both ends of the setting base 231 are placed on the workpiece holding parts 28A of the workpiece feed table 28.

Then, the rods 94 of the hydraulic cylinders 92 provided on the workpiece feed table 28 are extended so that the shoulders 231A of the setting base 231 can be pinched between the workpiece holding parts 28A and the tips of the rods 94. Thus, the attachment of the ingots 32 is completed.

In order to slice the ingots 32, the workpiece feed table 28 is fed toward the wire row 20, and the ingots 32 are pressed against the wire row 20 to be sliced into wafers.

Thus, in this embodiment, the ingots 32 which have different crystal orientations can be sliced at the same time, and thereby the manufacturing efficiency can be improved.

In this embodiment, the workpiece slicing method is used for slicing the ingots 32 having different crystal orientations; however, the slicing method should not be restricted to this. For example, the resistivity and impurity density of one ingot vary according to an axial directional position of the ingot, and a portion of the ingot is selected according to a semiconductor product to be manufactured. In this case, one ingot 32 is divided into a plurality of pieces, which are attached to the workpiece feed table 28 via the tilting units 30, and the plurality of pieces are sliced at the same time. In this case, the ingots have the same crystal orientations.

Next, an explanation will be given about the fifth embodiment of the present invention.

In the above-stated embodiments, the tilting unit has the construction as shown in FIGS. 2 and 3. In the fifth embodiment, the tilting unit has a different construction.

Figure 18:
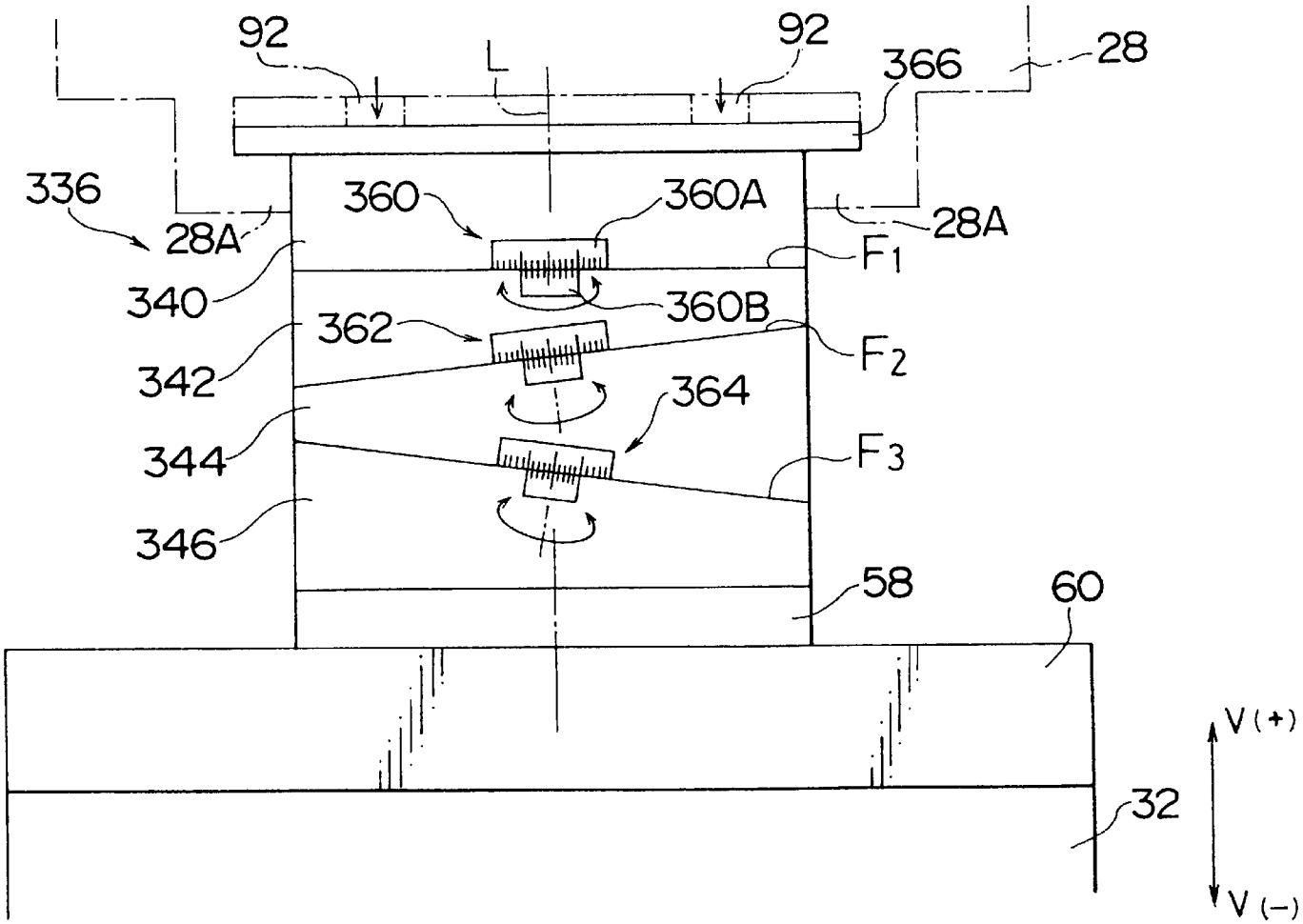
FIG. 18 is a side view of the tilting unit according to the fifth embodiment of the present invention.
Figure 19:
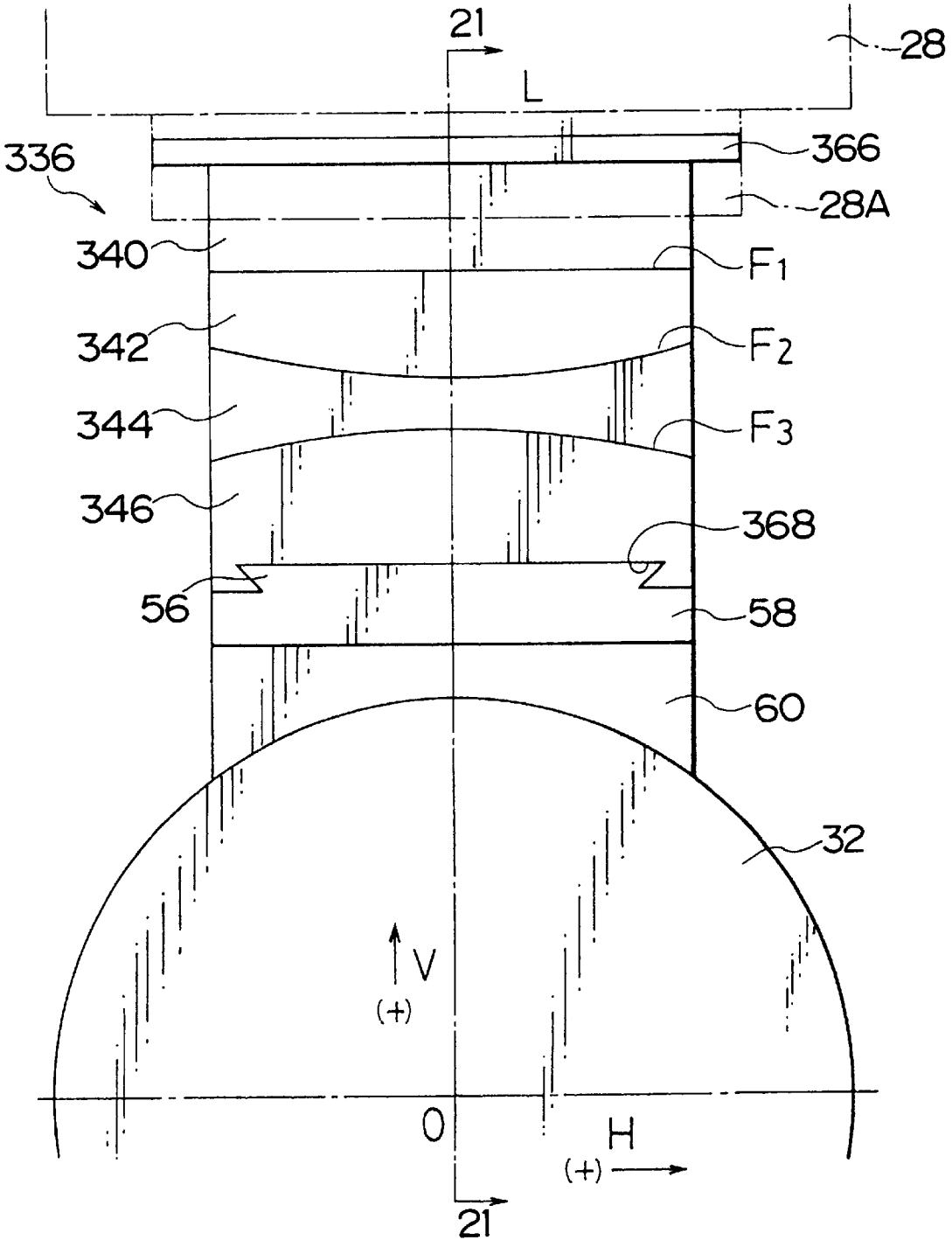
FIG. 19 is a front view of FIG. 18.
Figure 20:
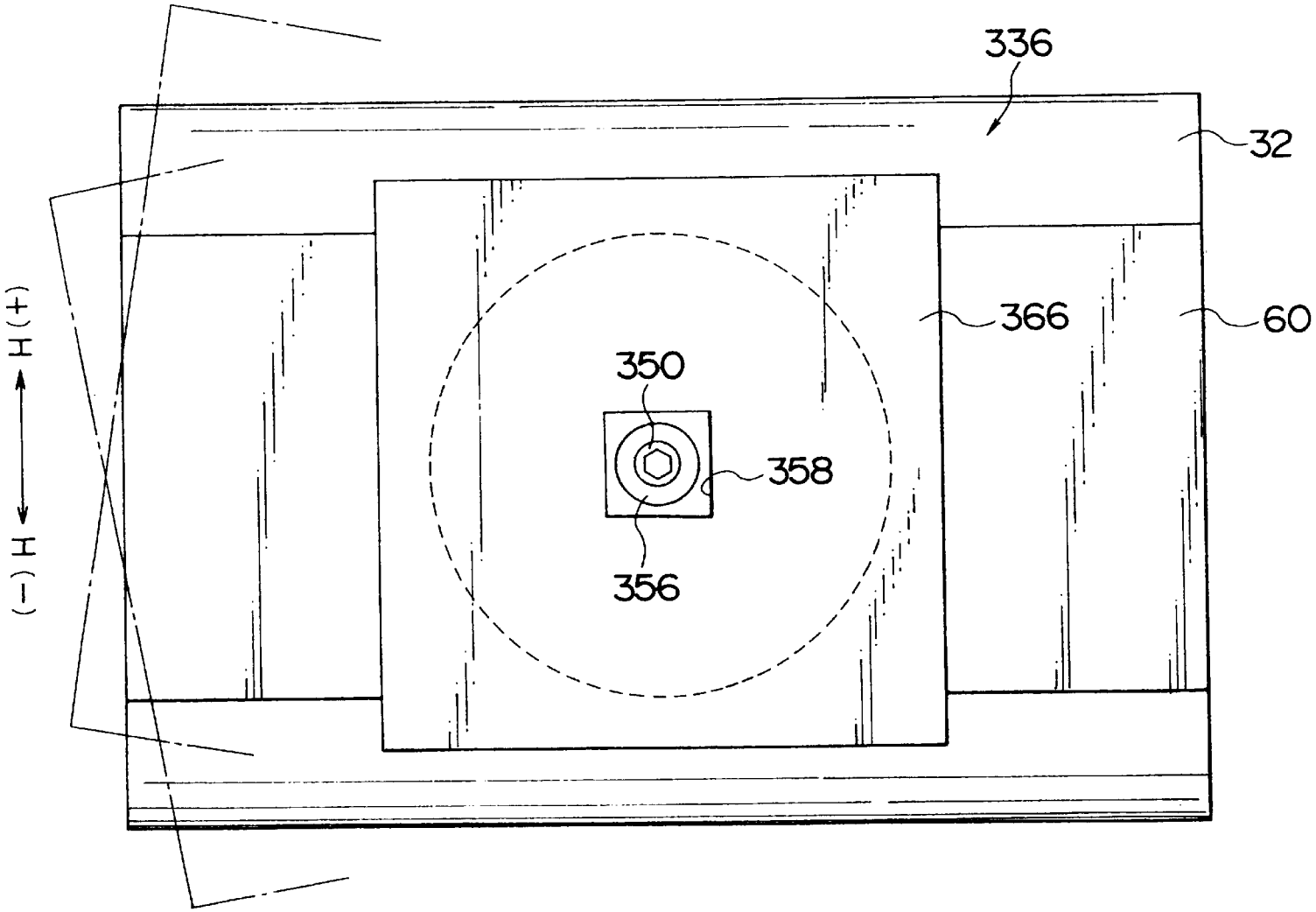
FIG. 20 is a top view of FIG. 18.

FIGS. 18, 19 and 20 are a side view, a front view and a top view, respectively, of the tilting unit.

As depicted in FIGS. 18 and 19, the tilting unit 336 is a column, which is divided into four portions by a face $F_1$ (the first face) vertical to the axis L of the column and two faces $F_2$ and $F_3$ (the second and third faces) which incline at predetermined angles with respect to the axis L. The divided portions 340, 342, 344 and 346 of the columnar are rotatably connected via connecting faces $F_1$, $F_2$ and $F_3$.

Figure 21:
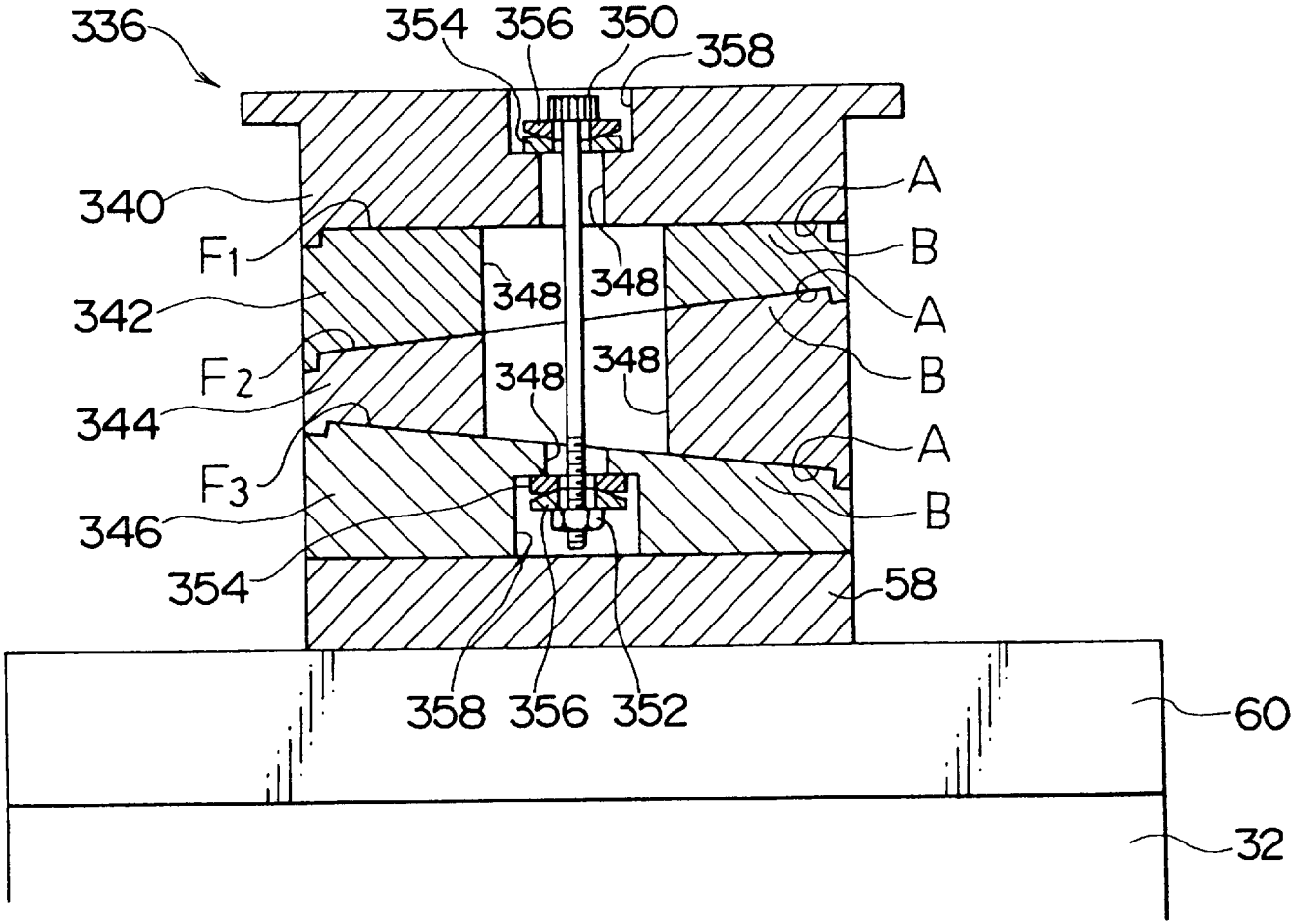
FIG. 21 is a sectional view taken on line 21—21 of FIG. 19.

FIG. 21 is a sectional view taken on line 21—21 of FIG. 19, and illustrates the inner structure of the tilting unit 336.

As depicted in FIG. 21, circular concave parts A are formed at one side of the connecting faces $F_1$, $F_2$ and $F_3$ of the divided portions 340, 342, 344 and 346, and circular convex parts B are formed at the other side of them. The concave parts A are engaged with the convex parts B so that the divided portions 340, 342, 344 and 346 can connect one another. The concave parts A and the convex parts B serve as guides while the divided portions 340, 342, 344 and 346 are rotating. Thus, the correspondence between the connecting faces of the divided portions 340, 342, 344 and 346 can be retained.

Holes 348, 348, . . . are formed along the axis L at the center of the divided portions 340, 342, 344 and 346. The divided portions 340, 342, 344 and 346 are fixed such that both ends thereof are fastened by a bolt 350 (with a hexagonal hole), which is inserted into the holes 348, and a nut 352. Spherical washers 356 are combined with countersink-shaped washers 354, and they are arranged between the bolt 350 and the divided portion 340 and between the divided portion 346 and the nut 352. Thereby, the bolt 350 can fasten the nut 352 without fail even if it is inclined. The bolt 350 and the nut 352 are housed in holes 358, which are formed at the end faces of the column, such that they do not project from the end faces.

According to the above-stated construction, the divided portions 340, 342, 344 and 346 rotate on the connecting faces $F_1$, $F_2$ and $F_3$ (the divided portions 340, 342, 344 and 346 will hereafter be referred to as a base block 340, a horizontal rotating block 342, a first vertical rotating block 344 and a second vertical rotating block 346 from the top to the bottom of the column).

The horizontal rotating block 342 rotates on the face $F_1$ vertical to the axis L, and the first horizontal rotating block 344 rotates on the face $F_2$ which inclines at a predetermined angle with respect to the axis L. The second vertical rotating block 346 rotates on the face $F_3$ which inclines at a predetermined angle with respect to the axis L.

The rotational angles of the horizontal rotating block 342, the first vertical rotating block 344 and the second vertical rotating block 346 are read by graduations 360, 362 and 364 on the peripheral surfaces thereof. In the case of the horizontal rotating block 342 for example, a primary scale 360A formed at the base block 340 is read by a vernier 360B formed at the horizontal rotating block 342.

As shown in FIGS. 18, 19 and 20, a square flange 366 is formed at the top of the column, and the column is mounted on the workpiece feed table 28 of the wire saw via the flange 366. The flange 366 is engaged with the workpiece holding parts 28A provided at the workpiece feed table 28, and the flange 366 is pushed and fastened by the cylinders 92, 92 provided on the workpiece feed table 28. The column mounted on the workpiece feed table 28 is held vertically to the wire row 20.

The column may be mounted on the workpiece feed table 28 via the setting base 31 as is the case with the first embodiment. As indicated in FIG. 19, a dovetail groove 368 is formed at the bottom end face of the column, and the dovetail 56 of the mounting plate 58 is engaged with the dovetail groove 368. The ingot 32 is attached to the bottom end face of the mounting plate 58 via the slice base mounting beam 60, and the dovetail 56 of the mounting plate 58 is engaged with the dovetail groove 368 of the column so that the ingot 32 can be mounted on the column. The ingot 32 is attached to the mounting plate 58 such that their central axes correspond to one another.

Next, an explanation will be given about the operation of the tilting unit which is constructed in the above-mentioned manner.

The adjustment of the tilt angles of the ingot 32 is performed at the outside of the wire saw 10 before the ingot 32 is mounted in the wire saw 10.

First, the slice base mounting beam 60 is attached to the side of the ingot 32, and the mounting plate 58 is attached to the slice base mounting beam 60. Then, the dovetail 56 of the ingot-mounted mounting plate 58 is engaged with the dovetail groove 368 of the tilting unit 336. Thus, the ingot 32 is mounted in the tilting unit 336.

Next, the vertical and horizontal components of the crystal orientation of the ingot 32 are determined by means of the X-ray crystal orientation determining equipment in a state where the ingot 32 is mounted in the tilting unit 336. Then, the tilt angles of the ingot 32 are adjusted based on the results of the determination by the X-ray crystal orientation determining equipment.

First, a holding means (not shown) holds the base block 340, and the bolt 350 is loosened. Thus, the horizontal rotating clock 342, the first vertical rotating block 344 and the second vertical rotating clock 346 become rotatable.

In FIG. 19, suppose that the axis of the ingot 32 is deviated by +1° in the vertical direction (in the direction V in the drawing: the upper side is +) and by +1° in the horizontal direction (in the direction H: the right side is +).

First, the ingot 32 is vertically tilted by −1° in order to compensate the deviation in the vertical direction. In this case, the first vertical rotating block 344 is turned by a predetermined angle on the second face $F_2$.

As indicated in FIG. 18, when the first vertical rotating block 344 is rotated clockwise on the second face $F_2$, the right cutting face of the ingot 32 is tilted diagonally and downwardly.

The relation between the rotational amount of the first vertical rotating block 344 and the tilt amount of the ingot 32 is predetermined according to the set inclined angle of the second face $F_2$. For this reason, the first vertical rotating block 344 is rotated by such an angle as to tilt the ingot 32 vertically by −1°.

While the first vertical rotating block 344 is rotated, the rotation is confirmed by means of the graduations 362.

Thus, the adjustment of the vertical tilt angle is completed, and then the horizontal tilt angle is adjusted.

In order to compensate the horizontal deviation, the horizontal rotating block 342 is rotated by a predetermined angle on the first face $F_1$.

As indicated in FIG. 18, when the horizontal rotating block 342 is rotated clockwise on the first face $F_1$, the ingot 32 rotates horizontally in the tilted state.

Since the first vertical rotating block 344 is rotated when the vertical tilt angle is adjusted, the ingot 32 is deviated horizontally from the initial reference state. Thus, the deviation must be compensated first in order to return the ingot 32 to the initial reference state.

For example, the ingot 32 is rotated by +3° horizontally due to the rotation of the first vertical rotating block 344, when the vertical tilt angle is adjusted. If the horizontal rotating block 342 is rotated counterclockwise by 3°, the ingot 32 returns to its initial reference state.

The horizontal tilt angle is adjusted in the above-stated state; that is, the horizontal rotating block 342 is further rotated by 1° horizontally toward (−) (counterclockwise).

As is the case with the first vertical rotating block 344, the horizontal rotating block 342 is rotated while the rotation is confirmed by means of the graduations 360.

The adjustment of the vertical and horizontal tilt angles is completed by a sequence of processes, and finally, the bolt 350 is tightened with the nut 352 so as to fasten the tilting unit 336.

The fastened tilting unit 336 is transported to the wire saw 10, and is fixed on the workpiece holding parts 28A of the workpiece feed table 28. As soon as the tilting unit 336 is fixed, the slicing starts.

In order to compensate the deviation to the (+) side, the second horizontal rotating block 346 is rotated by a predetermined angle on the third face $F_3$. Thereby, the right cutting face of the ingot 32 is tilted diagonally and upwardly, that is, vertically to the (+) side. The operation is performed in the same manner as the first vertical rotating block 344.

As stated above, the tilting unit according to this embodiment has an extremely simple structure, and is able to easily adjust the tilt angles. In addition, the tilting unit is capable of holding the ingot 32, whose tilt angles have been adjusted, with an extremely high rigidity.

Moreover, since the tilt angles can be adjusted at the outside of the wire saw 10, the slicing efficiency improves. That is, according to the tilting unit of this embodiment, during slicing of the ingot, the tilt angles of an ingot to be sliced next can be adjusted. Thus, the conventional tilting operation after the ingot is mounted can be omitted, and the wire saw can operate efficiently.

Furthermore, the tilt angles can be adjusted at the outside of the wire saw 10, and thereby the operation can be performed safely and easily compared to the conventional operation at a high place.

In addition, there is no need to provide the wire saw 10 with the tilting equipment, so that the construction of the wire saw 10 can be simple.

Figure 22:
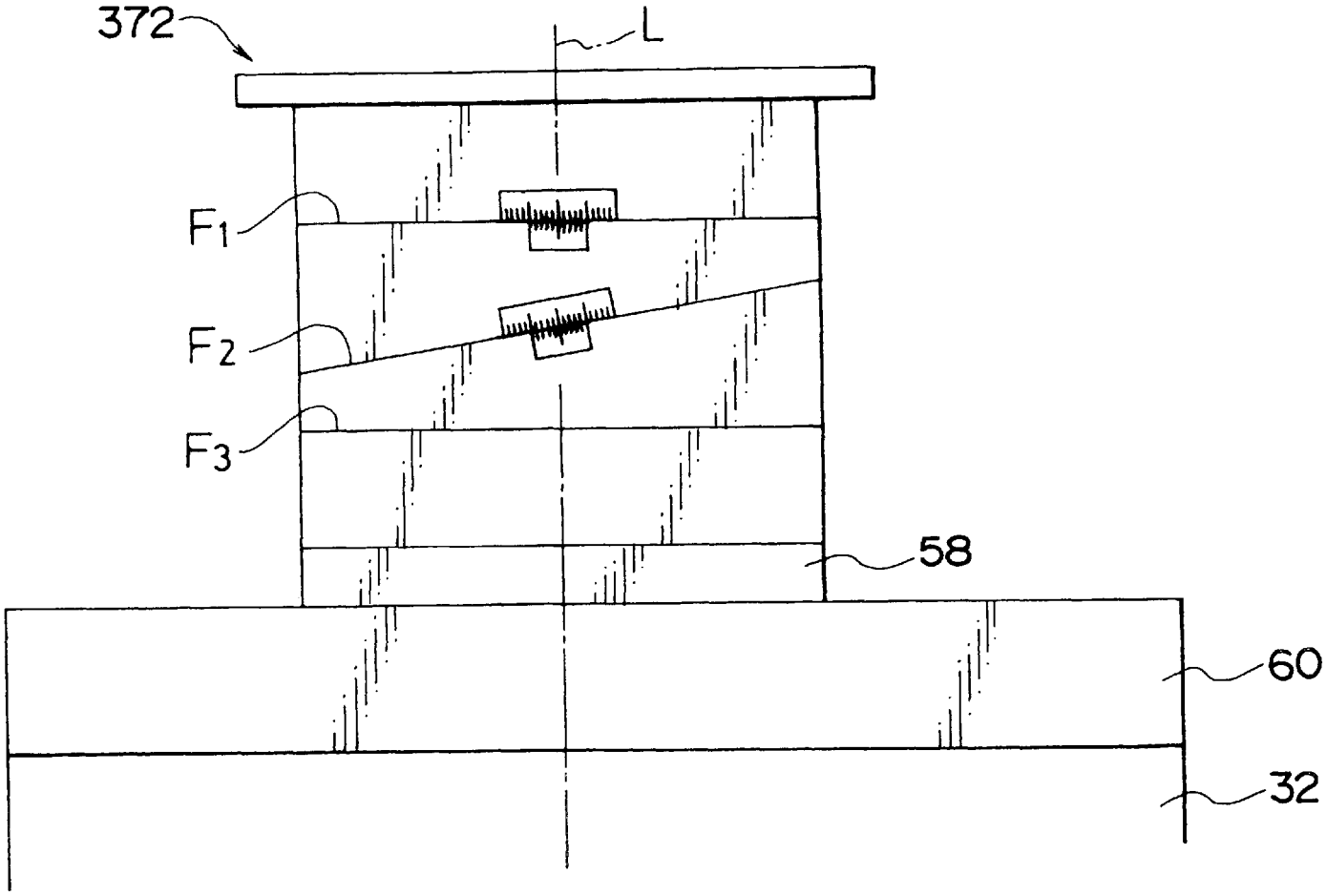
FIG. 22 is a side view of the tilting unit according to another embodiment of the present invention.

In the tilting unit according to this embodiment, as indicated in FIG. 18, the column is divided into four portions by the face $F_1$ (the first face), which is vertical to the axis L of the column, and two faces $F_2$ and $F_3$ (the second and third faces) which are inclined at predetermined angles with respect to the axis L; however, the number of vertical faces and tilted faces, the installing order of them, etc. should not be restricted to this. As depicted in FIG. 22, the column may be divided into four portions by the face $F_1$ (the first face) vertical to the axis L of the column, the face $F_2$ (the second face) which incline at a predetermined angle with respect to the axis L, and the face $F_3$ (the third face) which is vertical to the axis L.

According to the tilting unit 372 which is constructed as illustrated in FIG. 22, the adjustment of the vertical tilt angle of the ingot 32 can be performed only toward the minus side. The tilting unit 372, however, has two divided portions which rotate horizontally. In order to tilt the tilting unit 372 toward the plus side in the vertical direction, one portion, that is, the bottom portion is rotated by 180°. Thereby, the ingot 32 is rotated by 180°, and the direction of the vertical adjustment changes.

In the above-stated embodiments, the column, which composes the tilting unit, is a cylinder; however, it may be a prism.

As set forth hereinabove, according to the present invention, the adjustment of the horizontal and vertical tilt angles of the workpiece is performed first at the outside of the wire saw, and then the workpiece is attached to the workpiece feed table so that the workpiece can be sliced. Thereby, the wire saw can operate efficiently. Moreover, the adjustment of the tilt angles can be performed at the outside of the wire saw safely and easily compared to the conventional operation at a high and narrow place. Furthermore, there is no need to provide the wire saw with the tilting equipment, so that the construction of the wire saw can be simple.

Moreover, according to the present invention, the tilt angles of the workpiece can be adjusted on the X-ray crystal orientation determining equipment. Thereby, the tilt angles of the workpiece can be easily adjusted at the outside of the wire saw.

Furthermore, the present invention is provided with a plurality of tilting units, and a plurality of workpieces are attached to the plurality of tilting units so that the plurality of workpieces can be sliced at the same time. Thereby, the wafers can be manufactured efficiently.

In addition, according to the present invention, the tilting unit is the column which is divided by the vertical faces and the inclined faces, so that the construction of the tilting unit is extremely simple and the tilt angles can be easily adjusted.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A wire saw in which a running wire is wound on a plurality of grooved rollers to form a wire row, a workpiece is attached to a workpiece feed table which moves forward and backward with respect to said wire row, and said workpiece feed table is fed toward said wire row so as to press said workpiece against said wire row, so that said workpiece is sliced into a number of wafers, said wire saw comprising:

a tilting unit for holding said workpiece and tilting said workpiece horizontally and vertically by predetermined angles with respect to a plane including said wire row, said tilting unit being removably attached to said workpiece feed table; and wherein said tilting unit is operable for adjusting horizontal and vertical tilt angles of said workpiece, while removed from the workpiece feed table and being attachable to said workpiece feed table with the adjusted workpiece thereon so as to enable the wire slice said workpiece while properly oriented on the tilting unit.

2. The wire saw as defined in claim 1, wherein said tilting unit is composed of a plurality of tilt blocks which are capable of adjusting the horizontal and vertical tilt angles of said workpiece.

3. The wire saw as defined in claim 1, wherein said tilting unit is a column whose axis is vertical to said plane including said wire row, said column is divided by a first plane which is vertical to said axis and is divided by a second plane which is inclined at a predetermined angle with respect to said axis, the divided portions rotatably connect to one another, said divided portion is rotated on said first plane to adjust the horizontal tilt angle of said workpiece, and said divided portion is rotated on said second plane to adjust the vertical tilt angle of said workpiece.

4. Tilt angle adjusting equipment for adjusting horizontal and vertical tilt angles of a workpiece by means of a tilting unit, said equipment comprising:

a movable table for supporting said workpiece with said tilting unit and moving on a main body of said tilt angle adjusting equipment to a position for determining the crystal orientation of said workpiece;

X-ray crystal orientation determining equipment for electronically determining the crystal orientation of said workpiece, said X-ray crystal orientation determining equipment being provided on said main body and being provided with an X-ray projecting part projecting X-ray onto a cutting face of said workpiece and an X-ray receiving part receiving the X-ray reflected on said cutting face of said workpiece; and a electronically display part for displaying the vertical and horizontal components of the crystal orientation of said workpiece determined by said X-ray crystal orientation determining equipment.

5. The tilt angle adjusting equipment as defined in claim 4, wherein said tilting unit is composed of a plurality of tilt blocks which are capable of adjusting the vertical and horizontal tilt angles of said workpiece, said tilt angle adjusting equipment further comprising automatic bolt tightening equipment for tightening and loosening a bolt connecting said tilt blocks of said tilting unit.

6. The tilt angle adjusting equipment as defined in claim 4, wherein said tilting unit is composed of a plurality of tilt blocks which are capable of adjusting the vertical and horizontal tilt angles of said workpiece, said tilt angle adjusting equipment further comprising a controller for driving said tilt blocks of said tilting unit based on the crystal orientation of said workpiece determined by said X-ray crystal orientation determining equipment in order to automatically adjust the vertical and horizontal tilt angles of said workpiece.

7. A wire saw in which a running wire is wound on a plurality of grooved rollers to form a wire row, a workpiece is attached to a workpiece feed table which moves forward and backward with respect to said wire row, and said workpiece feed table is fed toward said wire row so as to press said workpiece against said wire row, so that said workpiece is sliced into a number of wafers, said wire saw comprising:

a plurality of tilting units for holding a plurality of workpieces and tilting said workpieces horizontally and vertically by predetermined angles with respect to a plane including said wire row, said tilting units being removably attached to said workpiece feed table and being operable for tilting of the workpiece by said angles when removed from the workpiece table; and wherein said wire saw slices the plurality of workpieces at the same time.

8. A workpiece slicing method of a wire saw in which a running wire is wound on a plurality of grooved rollers to form a wire row, a workpiece is attached to a workpiece feed table which moves forward and backward with respect to said wire row, and said workpiece feed table is fed toward said wire row so as to press said workpiece against said wire row, so that said workpiece is sliced into a number of wafers, said method comprising the steps of:

adjusting horizontal and vertical tilt angles of said workpiece prior to mounting of the workpiece on the workpiece feed table so that the face of the sliced wafer is a predetermined crystal face, and then attaching said workpiece to said workpiece feed table in order to slice said workpiece while retaining the horizontal and vertical tilt angles to which the workpiece was previously adjusted.

9. The workpiece slicing method of the wire saw as defined in claim 8, wherein the horizontal and vertical tilt angles of said workpiece are adjusted by means of a tilting unit for holding said workpiece and tilting said workpiece horizontally and vertically by predetermined angles with respect to a plane including said wire row, said tilting unit being removably attached to said workpiece feed table.

10. The workpiece slicing method of the wire saw as defined in claim 9, wherein the method of adjusting the horizontal and vertical tilt angles of said workpiece by means of said tilting unit comprises the steps of:

attaching said tilting unit to said workpiece;

placing said workpiece with said tilting unit on a movable table of X-ray crystal orientation determining equipment;

moving said workpiece on said movable table to a determining position of said X-ray crystal orientation determining equipment;

determining the crystal orientation of said workpiece by said X-ray crystal orientation determining equipment;

returning said workpiece to its original position; and adjusting the horizontal and vertical tilt angles of said workpiece based on the crystal orientation of said workpiece determined by said X-ray crystal orientation determining equipment.

11. The workpiece slicing method of the wire saw as defined in claim 10, wherein the method of adjusting the horizontal and vertical tilt angles of said workpiece by means of said tilting unit further comprises the step of:

after the horizontal and vertical tilt angles of said workpiece is adjusted, determining again, at said determining position, the crystal orientation of said workpiece by said X-ray crystal orientation determining equipment.

12. The workpiece slicing method of the wire saw as defined in claim 9, wherein the method of adjusting the horizontal and vertical tilt angles of said workpiece by means of said tilting unit comprises the steps of:

attaching said tilting unit to said workpiece;

placing said workpiece with said tilting unit on a movable table of X-ray crystal orientation determining equipment;

moving said workpiece on said movable table to a determining position of said X-ray crystal orientation determining equipment;

determining the crystal orientation of said workpiece by said X-ray crystal orientation determining equipment; and adjusting, at said determining position, the horizontal and vertical tilt angles of said workpiece based on the crystal orientation of said workpiece determined by said X-ray crystal orientation determining equipment.

13. The tilt angle adjusting equipment according to claim 4, wherein said tilting unit is removable from the movable table with the workpiece attached thereto for use thereof off of the tilt angle adjusting equipment.

* * * * *